US007451878B2

(12) United States Patent
Rochefort et al.

(10) Patent No.: US 7,451,878 B2
(45) Date of Patent: Nov. 18, 2008

(54) SHIPPING CONTAINER CONVERTIBLE TO DISPENSING OR ALL AROUND DISPLAY CONTAINER

(75) Inventors: Oscar Rochefort, Mississauga (CA); Michael McLeod, Romeoville, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 377 days.

(21) Appl. No.: 10/485,581

(22) PCT Filed: Aug. 2, 2002

(86) PCT No.: PCT/US02/24501

§ 371 (c)(1),
(2), (4) Date: Sep. 13, 2004

(87) PCT Pub. No.: WO03/011709

PCT Pub. Date: Feb. 13, 2003

(65) Prior Publication Data

US 2005/0000853 A1 Jan. 6, 2005

Related U.S. Application Data

(60) Provisional application No. 60/309,577, filed on Aug. 2, 2001.

(51) Int. Cl.
*B65D 75/58* (2006.01)

(52) U.S. Cl. ..... 206/738; 206/774; 229/235; 229/240

(58) Field of Classification Search ..... 206/427, 206/561, 736, 738, 769, 772, 774, 745, 746; 229/103.2, 103.3, 120.02, 120.24, 120.26, 229/200, 235, 240, 241, 242
See application file for complete search history.

(56) References Cited

U.S. PATENT DOCUMENTS

| | | | | |
|---|---|---|---|---|
| 3,260,440 | A * | 7/1966 | Foley | 229/120.26 |
| 3,884,348 | A | 5/1975 | Ross | |
| 4,113,100 | A | 9/1978 | Soja et al. | |
| 4,318,474 | A * | 3/1982 | Hasegawa | 229/242 |
| 5,098,757 | A | 3/1992 | Steel | |
| 5,167,324 | A | 12/1992 | Miller | |
| 5,505,372 | A * | 4/1996 | Edson et al. | 229/242 |
| 5,520,325 | A * | 5/1996 | Quaintance | 229/240 |
| 5,582,345 | A | 12/1996 | Lankhuijzen | |
| 5,651,497 | A | 7/1997 | Ventura et al. | |
| 5,881,884 | A | 3/1999 | Podosek | |
| 5,967,406 | A * | 10/1999 | Moorman | 206/427 |
| 6,189,780 | B1 * | 2/2001 | Kanter | 229/242 |
| 6,311,891 | B1 * | 11/2001 | Gardner | 229/120.24 |
| 6,386,369 | B2 * | 5/2002 | Yuhas et al. | 206/746 |
| 6,435,351 | B1 * | 8/2002 | Gibb | 206/736 |
| 7,175,066 | B2 | 2/2007 | Varanasi | |
| 2003/0222131 | A1 | 12/2003 | Justice | |

* cited by examiner

*Primary Examiner*—Luan K Bui
(74) *Attorney, Agent, or Firm*—Armstrong Teasdale LLP

(57) ABSTRACT

A shipping container for facilitating the conversion of the shipping container into a dispensing or all-around display container from formed an outer blank (10) having a centrally positioned bottom wall (12), front and rear walls (18, 26), top panels (32, 38), side flaps (14, 16, 22, 24, 28, 30, 34, 36, 40, 42) and an interior divider structure (50) for structural stacking support both during shipping and display modes.

32 Claims, 27 Drawing Sheets

BASIC BODY BLANK IS TRUNCATED FOR MATERIAL ECONOMY. TOP FLAPS ARE GREATLY GAPPED FOR FURTHER DISPLAY AND DISPENSING LIBERTIES.

TOP FLAPS CAN BE MADE TO MEET AS WELL

"BIKINI" TRUNCATED BODY BLANK FOR MATERIAL REDUCTIONS

SHIPPING CONTAINER CONVERTIBLE TO DISPENSING OR ALL AROUND DISPLAY CONTAINER

This application is a 371 of PCT/US02/24501, filed on Aug. 2, 2002 which claims benefit of 60/309,577 filed on Aug. 2, 2001.

BACKGROUND OF THE INVENTION

1. Field of the Invention

The present invention relates to shipping containers, in particular shipping containers that are fabricated at least in part from paper, paperboard and/or corrugated paperboard material. The present invention also relates to such containers that are convertible from a shipping configuration, to a display configuration.

2. The Prior Art

In stores which deal with dry goods that are sold in their own individual containers, such as grocery stores, a traditional method for placing the goods on display would be for store personnel to open the shipping containers in which the goods have been shipped from the supplier, and individually place each item on the shelf, and arrange them neatly for presentation. Typically, such containers were often structures dedicated solely to a shipping function, and when opened, were either destroyed, or resulted in an open-topped container not well suited for merchandising functions.

However, this process of individual removal of goods from a shipping container, and placement on shelves, is relatively costly to the store in terms of personnel effort, time, wages, etc. Therefore, it has become desirable to reduce costs in converting goods packaged for shipping into a suitable format for display and shopping.

This has resulted in the development of a variety of containers which are configured to be convertible from a shipping configuration, to a display configuration, which permits the converted container to be placed directly upon a shelf, or floor display, without having to remove the individual product items from the container. Typically, this is accomplished by providing the container with removable portions of the container that create apertures through which customers may then help themselves to the products within the converted container.

Such convertible containers represent a challenge in that they must be readily convertible into a form presentable to customers, while at the same time maintaining certain shipping performance characteristics, suitable for the shipment of non-self-supporting or even fragile products. In order to reduce cost in opening and placement of the converted container, the container should be hand-convertible, without the use of a knife or other implement. At the same time, it is desirable to provide a converted display container that is relatively free of unsightly or inconvenient rough edges or debris.

However, such prior art convertible containers often are either lacking in the necessary shipping performance characteristics or, in order to provide such performance, even after conversion, have structural elements that remain in position and make access to the product less convenient than desired. Other container constructions may achieve one or both of the performance or convenience goals, but at the expense of an inefficient or simply excessive use of container material.

It is accordingly desirable to provide a shipping container that is convertible to a display configuration, that has improved shipping performance characteristics, together with enhanced ease of conversion, and improved "shopability" for the consumer.

These and other desirable characteristics of the present invention will become apparent in view of the present specification and drawings.

SUMMARY OF THE INVENTION

The present invention comprises, in part, a shipping container convertible to a display container, comprising an outer wrap including a bottom wall; a front wall connected to a front edge of the bottom wall; a rear wall connected to a rear edge of the bottom wall; a first top panel connected to a top edge of the front wall and extending rearwardly therefrom; a second top panel connected to a top edge of the rear wall and extending forwardly therefrom; first and second front side panels connected to respective side edges of the front wall and extending rearwardly therefrom; first and second rear side panels connected to respective side edges of the rear wall and extending forwardly therefrom; first and second bottom side flaps connected to side edges of the bottom wall and extending upwardly therefrom, the first and second bottom side flaps overlapping lower portions of the first and second front and rear side panels; first and second front top flaps connected to side edges of the front top panel, and extending downwardly therefrom; first and second rear top flaps connected to side edges of the rear top panel, and extending downwardly therefrom; at least one of the front wall, rear wall, first and second top panels, first and second front side panels, and first and second rear side panels including regions of weakness for facilitating removal of portions thereof, for facilitated access to an interior region of the shipping container.

The present invention also comprises, in an alternatively embodiment, a shipping container convertible to a display container, comprising an outer wrap including a bottom wall; a front wall connected to a front edge of the bottom wall; a rear wall connected to a rear edge of the bottom wall; a first top panel connected to a top edge of the front wall and extending rearwardly therefrom; a second top panel connected to a top edge of the rear wall and extending forwardly therefrom; first and second front side panels connected to respective side edges of the front wall and extending rearwardly therefrom; first and second rear side panels connected to respective side edges of the rear wall and extending forwardly therefrom; first and second bottom side flaps connected to side edges of the bottom wall and extending upwardly therefrom, the first and second bottom side flaps overlapping lower portions of the first and second front and rear side panels; first and second front top flaps connected to top edges of the front side panels, and extending rearwardly therefrom; first and second rear top flaps connected to top edges of the rear side panels, and extending forwardly therefrom; at least one of the front wall, rear wall, first and second top panels, first and second front side panels, and first and second rear side panels including regions of weakness for facilitating removal of portions thereof, for facilitated access to an interior region of the shipping container.

The present invention in a preferred embodiment, may further comprise an internal support structure including at least one internal wall member extending vertically between the bottom wall and at least one of the first and second top panels. The internal support structure may have an E-shaped top plan configuration. Alternatively, the internal support structure is in the form of a symmetric H-shaped divider. In another embodiment, the internal support structure is in the form of an asymmetrical H-shaped divider. In another alternative embodiment, the internal support is in the form of a five-cell divider, having an internal diamond-shaped column. In still another alternative embodiment, the internal support is in the form of a linked "C" four cell support divider. In yet another alternative embodiment, the internal support is in the form of a five cell divider having an internal rectangular columnar support. In still yet another alternative embodiment, the internal support is in the form of an asymmetrical three cell divider. In another embodiment of the invention, the internal support is in the form of single cell "U" shaped support divider.

In another embodiment, the shipping container may further comprise an opening disposed in at least one of the front wall and the back wall, extending from one side edge of the wall to an opposite side edge of the wall, dividing the wall into a lower panel having an upper free edge and an upper face panel having a lower free edge.

The regions of weakness may comprise a first perforation, extending from the lower free edge of the upper face panel toward a top edge of the upper face panel, adjacent one side edge thereof; a second perforation, extending from the lower free edge of the upper face panel toward the top edge of the upper face panel, adjacent an opposite side edge thereof; and a third perforation, extending along the top edge of the upper face panel, the first, second and third perforations enabling the facilitated removal of the upper face panel from remaining portions of the shipping container.

The first and second front top flaps may be affixed to the first and second front side panels, respectively, wherein the regions of weakness may comprise first and second pairs of lines of perforations, disposed in the first and second front side panels, respectively, defining first and second zipper pull tabs, respectively, whereupon removal of the first and second zipper pull tabs, the upper face panel, the front top panel, first and second front top flaps and upper portions of the first and second front side panels are removable as a unit, to provide front and top access to remaining portions of the shipping container.

The first and second rear top flaps may be affixed to the first and second rear side panels, respectively, wherein the regions of weakness comprise first and second pairs of lines of perforations, disposed in the first and second rear side panels, respectively, and extending into and meeting in the rear wall panel, defining at least a third zipper pull tab, respectively, whereupon removal of the first, second, and at least third zipper pull tabs, the upper face panel, the front top panel, first and second front top flaps, upper portions of the first and second front side panels, the rear top panel, first and second rear top flaps, upper portions of the first and second rear side panels, and an upper portion of the rear wall are removable as a unit, to provide front, top and rear access to remaining portions of the shipping container.

The internal support structure may be affixed only to at least one of the top wall, the upper face panel, an upper portion of the first front side panel, an upper portion of the second front side panel, an upper portion of the first rear side panel, an upper portion of the second rear side panel, and an upper portion of the rear wall, whereupon removal of the first, second and at least third zipper pull tabs, the internal support structure is removable with the upper face panel, the front top panel, first and second front top flaps, upper portions of the first and second front side panels, the rear top panel, first and second rear top flaps, upper portions of the first and second rear side panels, and an upper portion of the rear wall, as a unit, leaving an open-topped tray as a remaining structure.

The first and second rear top flaps may be affixed to the first and second rear side panels, respectively, wherein the regions of weakness comprise a tear tape, disposed in the first and second rear side panels, and extending across the rear wall panel, whereupon removal of the first and second zipper pull tabs and the tear tape, the upper face panel, the front top panel, first and second front top flaps, upper portions of the first and second front side panels, the rear top panel, first and second rear top flaps, upper portions of the first and second rear side panels, and an upper portion of the rear wall are removable as a unit, to provide front, top and rear access to remaining portions of the shipping container.

The internal support structure may be affixed only to at least one of the top wall, the upper face panel, an upper portion of the first front side panel, an upper portion of the second front side panel, an upper portion of the first rear side panel, an upper portion of the second rear side panel, and an upper portion of the rear wall, whereupon removal of the first and second zipper pull tabs and the tear tape, the internal support structure is removable with the upper face panel, the front top panel, first and second front top flaps, upper portions of the first and second front side panels, the rear top panel, first and second rear top flaps, upper portions of the first and second rear side panels, and an upper portion of the rear wall, as a unit, leaving an open-topped tray as a remaining structure.

The at least one internal wall member may be extending vertically between the bottom wall and at least one of the first and second top panels, and may include at least one outwardly projecting tab, and wherein at least one of the front top panel, the rear top panel, the front wall and the rear wall includes a notch operably configured for insertably receiving the at least one outwardly projecting tab.

In preferred embodiments of the invention, the internal support structure is fabricated from a blank separate and apart from the outer wrap.

The present invention also comprises, in part, a shipping container convertible to a display container, comprising a first blank having a rectangular bottom wall; a front wall emanating from a front edge of the bottom wall; a rear wall emanating from an opposite rear edge of the bottom wall; a first top panel emanating from an edge of the front wall opposite the front edge of the bottom wall; a second top panel emanating from an edge of the rear wall opposite the front edge of the bottom wall; first and second front side panels emanating from respective first and second side edges of the front wall; first and second rear side panels emanating from respective first and second side edges of the rear wall; first and second bottom side flaps emanating from first and second side edges of the bottom wall, the first and second side edges extending substantially perpendicular to the front and rear edges of the bottom wall; first and second front top flaps emanating from first and second side edges of the front top panel; first and second rear top flaps emanating from first and second side edges of the rear top panel; at least one of the front wall, rear wall, first and second top panels, first and second front side panels, and first and second rear side panels including regions of weakness for facilitating removal of portions thereof, for facilitated access to an interior region of the shipping container.

The present invention also comprises in part, a shipping container convertible to a display container, comprising a blank having a rectangular bottom wall; a front wall emanating from a front edge of the bottom wall; a rear wall emanating from an opposite rear edge of the bottom wall; a first top panel emanating from an edge of the front wall opposite the front edge of the bottom wall; a second top panel emanating from an edge of the rear wall opposite the front edge of the bottom wall; first and second front side panels emanating from respective first and second side edges of the front wall; first and second rear side panels emanating from respective first and second side edges of the rear wall; first and second bottom side flaps emanating from first and second side edges of the bottom wall, the first and second side edges extending substantially perpendicular to the front and rear edges of the bottom wall; first and second front top flaps emanating from top edges of the first and second front side panels; first and second rear top flaps emanating from top edges of the first and second rear side panels; at least one of the front wall, rear wall, first and second top panels, first and second front side panels, and first and second rear side panels including regions of weakness for facilitating removal of portions thereof, for facilitated access to an interior region of the shipping container.

The first blank may further comprise an opening disposed in at least one of the front wall and the rear wall, extending from one side edge of the wall to an opposite side edge of the front, dividing the front wall into a lower panel having an upper free edge and an upper face panel having a lower free edge.

The regions of weakness may comprise a first perforation, extending from the lower free edge of the upper face panel toward a top edge of the upper face panel, adjacent one side edge thereof; a second perforation, extending from the lower free edge of the upper face panel toward the top edge of the upper face panel, adjacent an opposite side edge thereof; and a third perforation, extending along the top edge of the upper face panel, the first, second and third perforations enabling the facilitated removal of the upper face panel from remaining portions of the shipping container.

The regions of weakness may also comprise first and second pairs of lines of perforations, disposed in the first and second front side panels, respectively, defining first and second zipper pull tabs, respectively.

The regions of weakness may alternatively comprise first and second pairs of lines of perforations, disposed in the first and second rear side panels, respectively, and extending into and meeting in the rear wall panel, defining at least a third zipper pull tab.

Alternatively, the regions of weakness may comprise a tear tape, disposed in the first and second rear side panels, and extending across the rear wall panel.

The first blank may further comprise an opening disposed in at least one of the front wall and the rear wall, extending from one side edge of the wall to an opposite side edge of the wall, dividing the wall into a front lower panel having an upper free edge and an upper face panel having a lower free edge.

The shipping containers of the present invention may further comprise markings disposed upon an outer surface of the outer wrap, for indicating locations for manual cutting of the outer wrap.

DETAILED DESCRIPTION OF THE DRAWINGS

Figure 1:
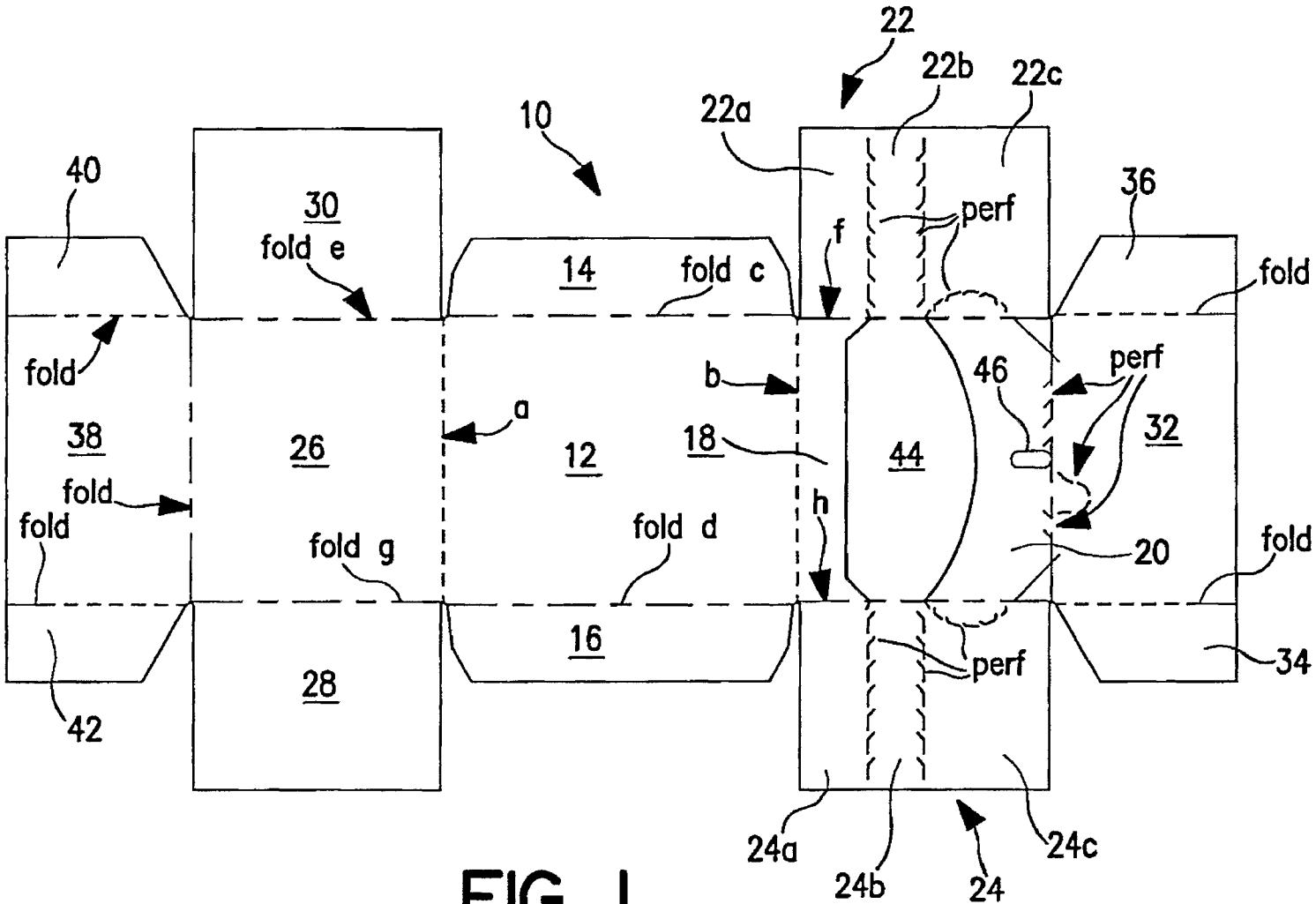
FIG. 1 is a plan view of a blank for the outer wrap portion of a convertible shipping container according to one embodiment of the invention, having zipper pull tabs associated with only the front side panels.

While this invention is susceptible of embodiment in many different forms, there is shown in the drawings and will be described in detail, a specific embodiment, with the understanding that the present disclosure is to be considered as an exemplification of the principles of the invention and is not intended to limit the invention to the embodiment illustrated.

The present invention is directed to a container that is constructed with a shipping configuration that is convertible to a dispensing configuration, or in alternative embodiments, to either a dispensing or display configuration. The container construction belongs to the type known as a wraparound container and/or tray containers, with an internal divider/structural support member. That is, in a wraparound configuration, the product, plus internal divider, may be positioned onto a completely flat blank, which is then erected around the product, in a wraparound fashion. Alternatively, and using the same blank, the container may be erected, tray-style, leaving the top panels open, to receive the product, plus internal support/divider (from above, typically), and then the top panels and flaps of the container will be closed and sealed. Thus, depending upon the sequence of steps, the same blank can serve in a wraparound packaging capacity, as well as in a tray-style capacity.

In the figures, unless otherwise noted, the usual convention is observed that solid lines on the interior of a figure represent cuts, edges or points of inflection (like a ridge, crease or inwardly or outwardly projecting gusset), and broken or dashed lines indicate folds, score lines or other lines of weakness.

In each of the embodiments of the invention illustrated and/or described herein, the preferred material for each of the outer wrap and the internal support/divider is corrugated paperboard, although other materials may be used for each, as may be required or desired.

Figure 2:
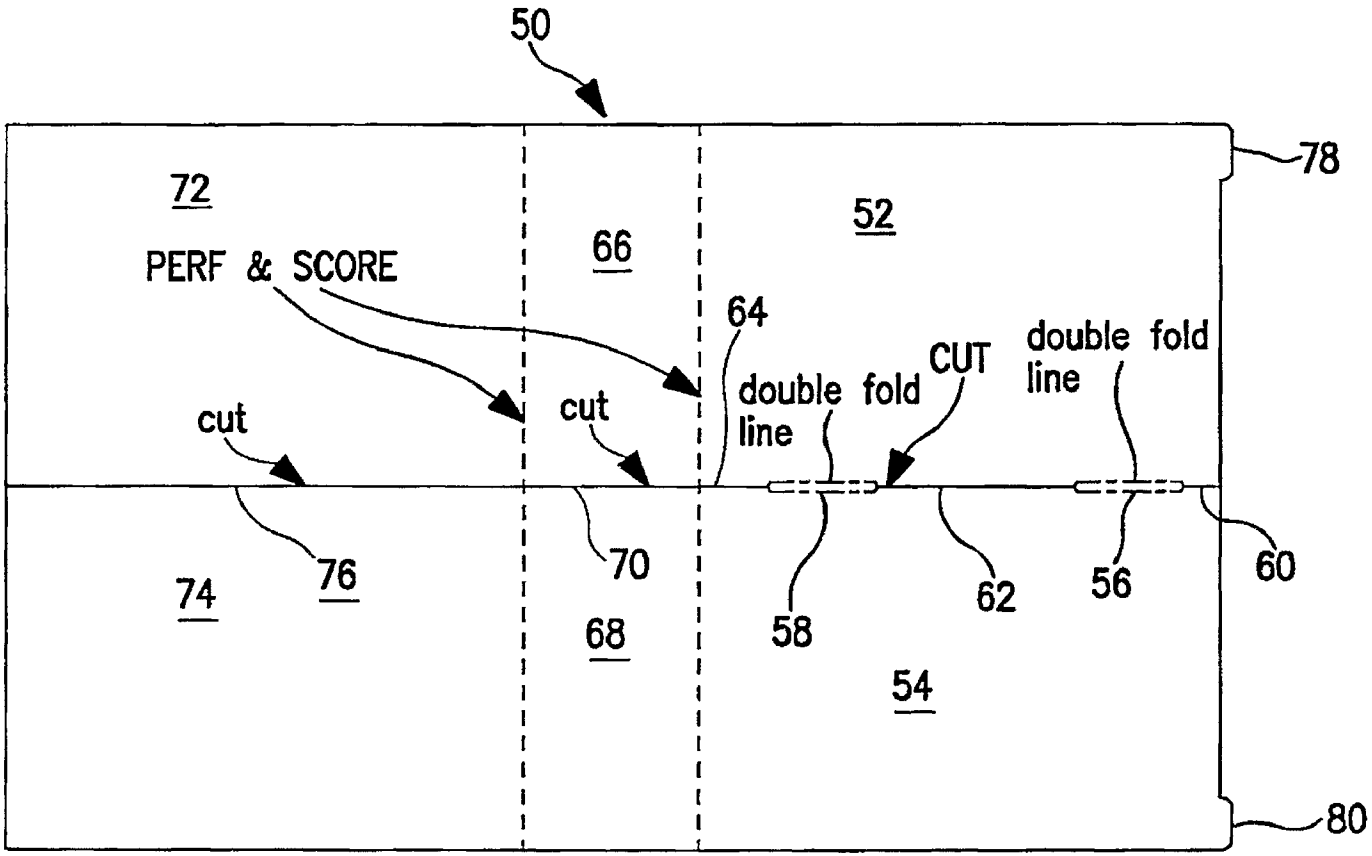
FIG. 2 is a plan view of a blank for the internal divider/structural support member that is common to the several embodiments of the convertible shipping containers of the present invention.

The components of the most basic form of the container are shown in FIGS. 1 and 2, wherein FIG. 1 illustrates the blank for the outer wrap portion, and FIG. 2 illustrates the blank for the internal divider/structural support member.

Blank 10 for the outer wrap portion includes bottom 12, bottom side panels 14, 16, front lower panel 18, removable face panel 20, face side panels 22 (including lower panel 22*a*, zipper pull tab 22*b*, and upper panel 22*c*) and 24 (including lower panel 24*a*, zipper pull tab 24*b*, and upper panel 24*c*), back panel 26, back side panels 28, 30, forward top panel 32, forward top side panels 34, 36, rear top panel 38, and rear top side panels 40, 42. Opening 44 separates front lower panel 18 and removable face panel 20, portions of which extend into the adjacent face side panels. In alternative embodiments opening 44 may be replaced with a solid panel.

A further vertically oriented oblong opening or slot 46 touches upon the line of perforations/cuts/scores separating panel 20 from panel 32. In a preferred embodiment of the invention, the distance from fold line a to fold line b is approximately equal to or greater than the total distance from fold line e to the opposite free edge of panel 30 and from fold line f to the opposite free edge of panel 22 (or the total distance from fold line g to the opposite free edge of panel 28 and from fold line h to the opposite free edge of panel 24), so that the front and rear side panels of the resultant container preferably do not overlap, but at most abut at their free edges.

Blank 50 for the internal divider/structural support member for the containers includes first and second divider panels 52, 54, that are connected by double fold line pairs 56, 58, between cuts 60, 62, 64. Back divider panels 66, 68 emanate from the rear edges of panels 52, 54, respectively. Panels 66, 68 are separated by cut 70. Side divider panels 72, 74 emanate from back divider panels 66, 68, respectively, and are separated by cut 76. Panels 52, 54 include projecting tabs 78, 80.

Figures 5A, 5B, 5C, 5D, 5E:
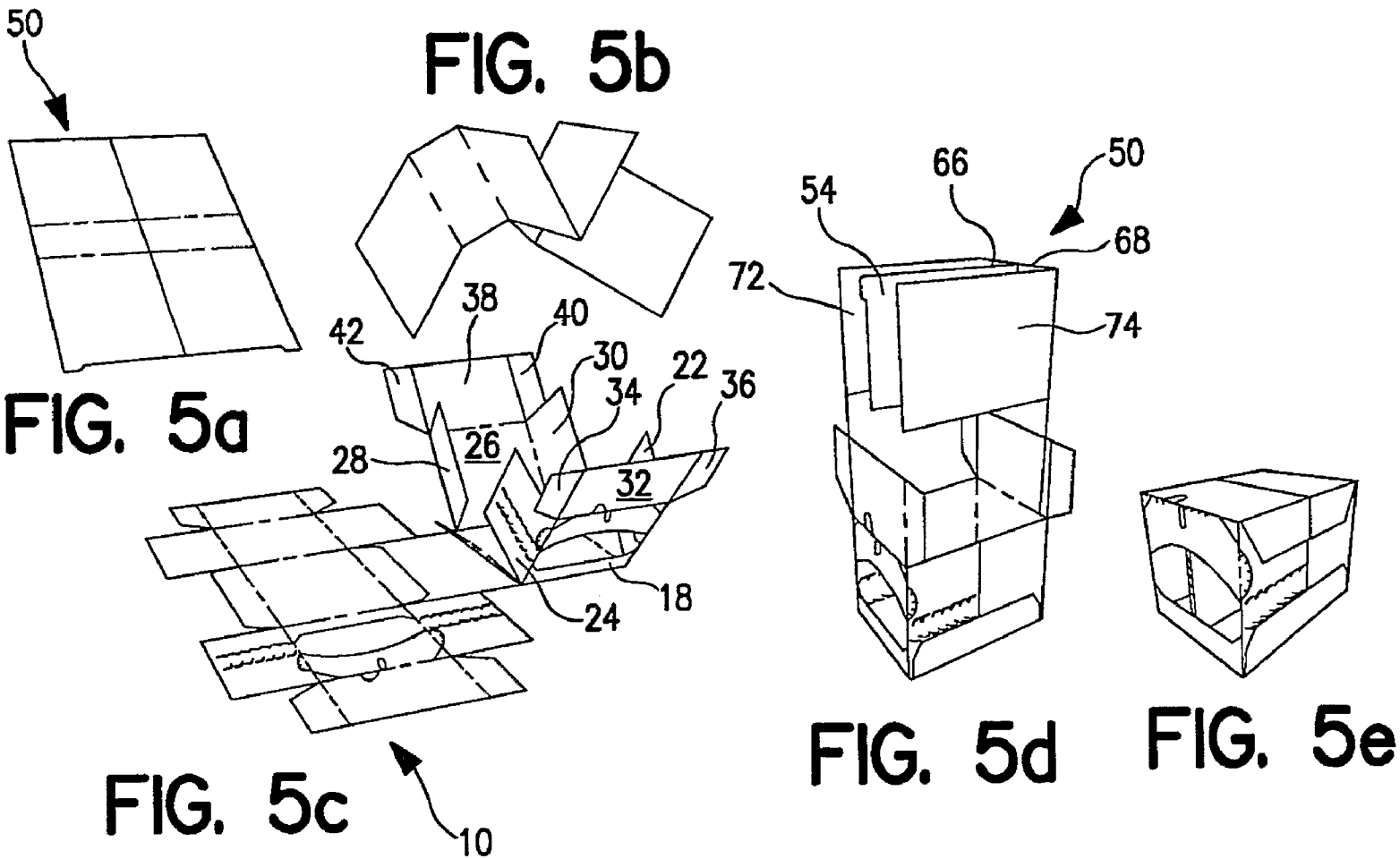
FIGS. 5*a*-5*e* are illustrations of the development of the articulation steps for a convertible shipping container according to the embodiment of FIGS. 1 and 2, from flat blanks for the outer wrap and internal divider/support structure, to a finished container.

The formation of blanks 10, 50 into a complete container is shown in FIGS. 5*a*-5*e*. FIG. 5*a* is a perspective view of flat blank 50 for the inserted interior divider/support structure of FIG. 2. FIG. 5*b* is a perspective view of partially folded blank 50 for the inserted interior divider/support structure of FIG. 2. FIG. 5*c* shows, on the left, a flat perspective view of blank 10, and on the right, blank 10 partially erected. FIG. 5*d* illustrates blank 10 substantially completely erected, for insertion of fully articulated blank 50. FIG. 5*e* illustrates a perspective view of a fully articulated and glued (but empty) container.

The divider is formed by folding panels 52, 54 about fold line pairs 56, 58, until panels 52, 54 are adjacent and face-to-face and, preferably glued together. Panels 66, 68 are folded perpendicular to panels 52, 54, and then panels 72, 74 are folded perpendicular to panels 66, 68, to form an "E"-shaped structure.

The wraparound portion is formed, in part, by folding panels 18 and 26 upwardly, to positions perpendicular to bottom panel 12. Panels 22, 24 are folded inwardly perpendicular to panel 18, while panels 28, 30 are folded inwardly perpendicular to panel 26. Panels 14, 16 are then folded up perpendicular to bottom 12, and attached (e.g., by glue) to panels 22*a*, 24*a*, 28 and 30, to form a completed tray container bottom, with an open top, as shown in the right center of FIG. 5*a*-5*e*. As this is a wraparound structure, product may be positioned on bottom panel 12, while the folding process just described is performed. Likewise, the divider may or may not be positioned on bottom panel 12 and held in place (not adhered), while the folding process takes place. Alternatively, the product and/or the divider may not be positioned until the wraparound portion has achieved the orientation of the left center illustration of FIG. 5*a*-5*e*.

In either manner of assembly, tabs 78, 80, are aligned in the formed E-shaped divider, and are received in opening/slot 46, which holds the center leg of the "E" in place and prevents it from shifting from side to side.

Once the product and divider/structural support member are in place, panels 32 and 38 are folded down perpendicular to the front and rear panels. Panels 34, 36 are folded down and adhered to panels 24*c*, 22*c*, respectively. Panels 40, 42 are folded down and adhered to panels 30, 28, respectively, to form the completely closed container shown at the far right in FIG. 5*a*-5*e*. It is important that while the rear portions of the upper edges of the divider/structural support member may and preferably are affixed (e.g., by gluing) to the inside surfaces of panel 26 (and the rear wall), or alternatively or in addition, to the inside surfaces of the top panel(s), the front portions of the upper edges of the divider/structural support member should not be affixed to any other components. Likewise, none of the lower surfaces of the divider/structural support member should be affixed to any other components.

Figure 6:
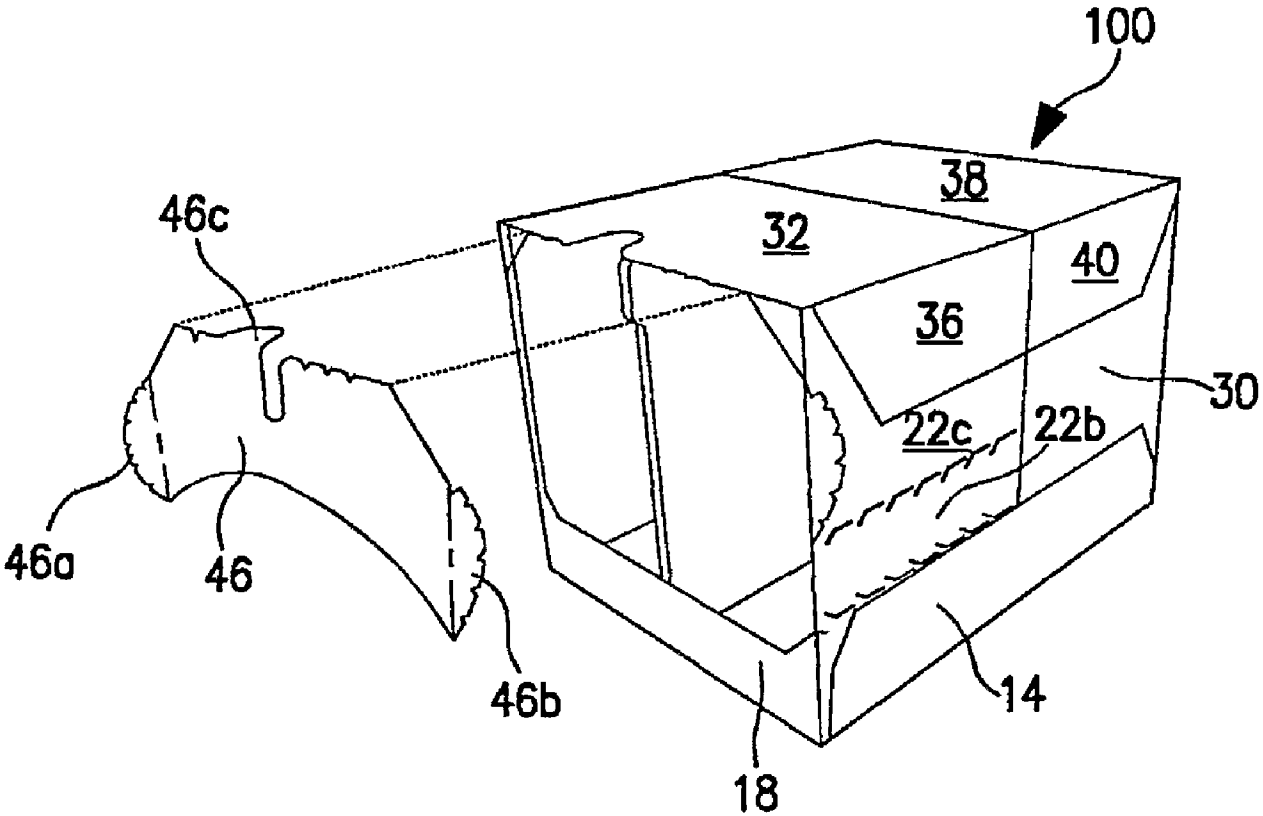
FIG. 6 is an illustration of an initial step for opening a convertible shipping container, according to the embodiment of FIGS. 1, 2 and 5*a*-5*e*, for providing for a front-access display configuration.

A step in one method of opening the container of FIGS. 1, 2 and 5*a*-5*e*, is shown in FIG. 6. Removable face panel 46 is pulled away from container 100, for enabling dispensing of product. While a particular configuration for face panel 46, with its associated panels 46*a* and 46*b*, has been shown, it is to be understood that the configuration of the opening formed in part by the lower edge of face panel 46, as well as the positioning or even presence of the diagonal cuts at the top corners of panel 46, as well as the placement and configuration of panels 46*a* and 46*b* may be modified by one of ordinary skill in the art, having the present disclosure before them, without departing from the scope of the present invention. Removal may be assisted by the presence of tab portions 46*a*, 46*b* and 46*c*, which may be pushed in, to provide gripping access for removal of panel 46. Because panel 46 extends across the full width of container 100, the two cells for holding product are fully exposed, to permit the product (e.g., bottles) to be tipped out of the front of each cell, with no structural members remaining in the plane of the face of the container (other than panel 18, which serves to keep the product from simply sliding out of the front of the container), around which the product must be pulled. The configuration shown in FIG. 6, may be considered as a "dispensing" configuration, as the product must be removed sequentially, one at a time, from the opened container.

Figure 7B:
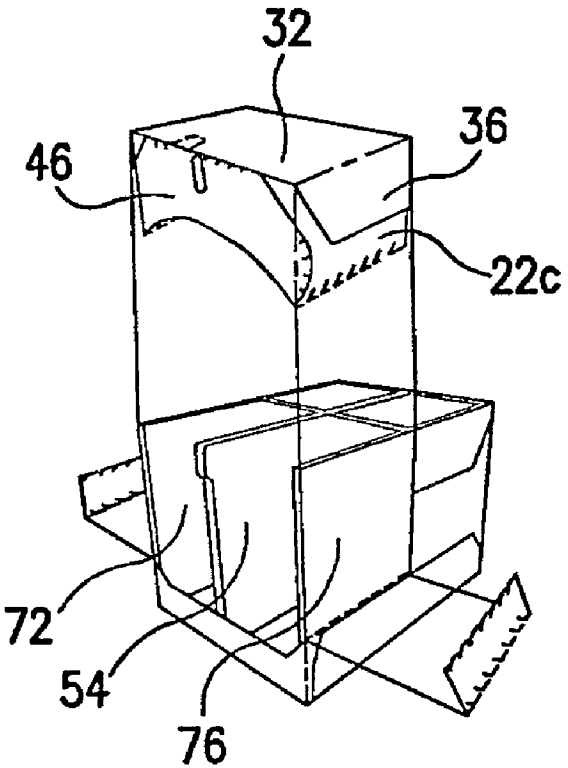
FIG. 7*b* illustrates an alternative initial step for opening a convertible shipping container, according to the embodiment of FIGS. 1, 2, and 5*a*-5*e*, wherein one of the zipper pull tabs is being removed.
Figure 7A:
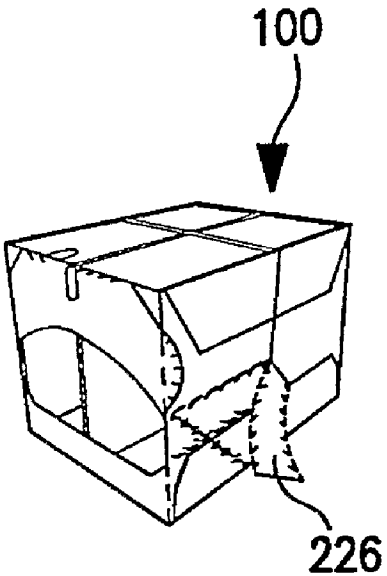
FIG. 7*a* illustrates subsequent steps for opening a convertible shipping container, according to the embodiment of FIGS. 1, 2, and 5*a*-5*e*, wherein both of the zipper pull tabs have been removed, leaving the upper face panel in position, enabling removal of the upper face panel, the front top panel, the front top panel flaps, and upper portions of the front side panels, as a unit.

A second or alternative stage in the opening of container 100 is shown in FIGS. 7*a* and 7*b*. 8. Instead of tearing away panel 46, zipper pull tabs 22*b*, 24*b* are torn away (not having been adhesively affixed to adjacent panels 72, 74). Because the front portions of the upper edges of the divider/structural support member are not adhered to panel 32, upon removal of tear strips 22*b*, 24*b*, panels 32, 34, 36, 22*c*, 24*c* and 46 (which together may be considered as a "cap"), can be lifted off of container 100 as a unit. Alternatively, panel 46 may be torn away before removal of zipper pull tabs 22*b*, 24*b*, and if the accessibility to the product is deemed insufficient, then the tear strips may be removed, permitting removal of the remainder of the "cap". In either mode of operation, removal of the cap leaves a rear portion of the upper end of the container still closed, requiring removal of product from either the direct front, or from the front top region of the container.

Figure 3:
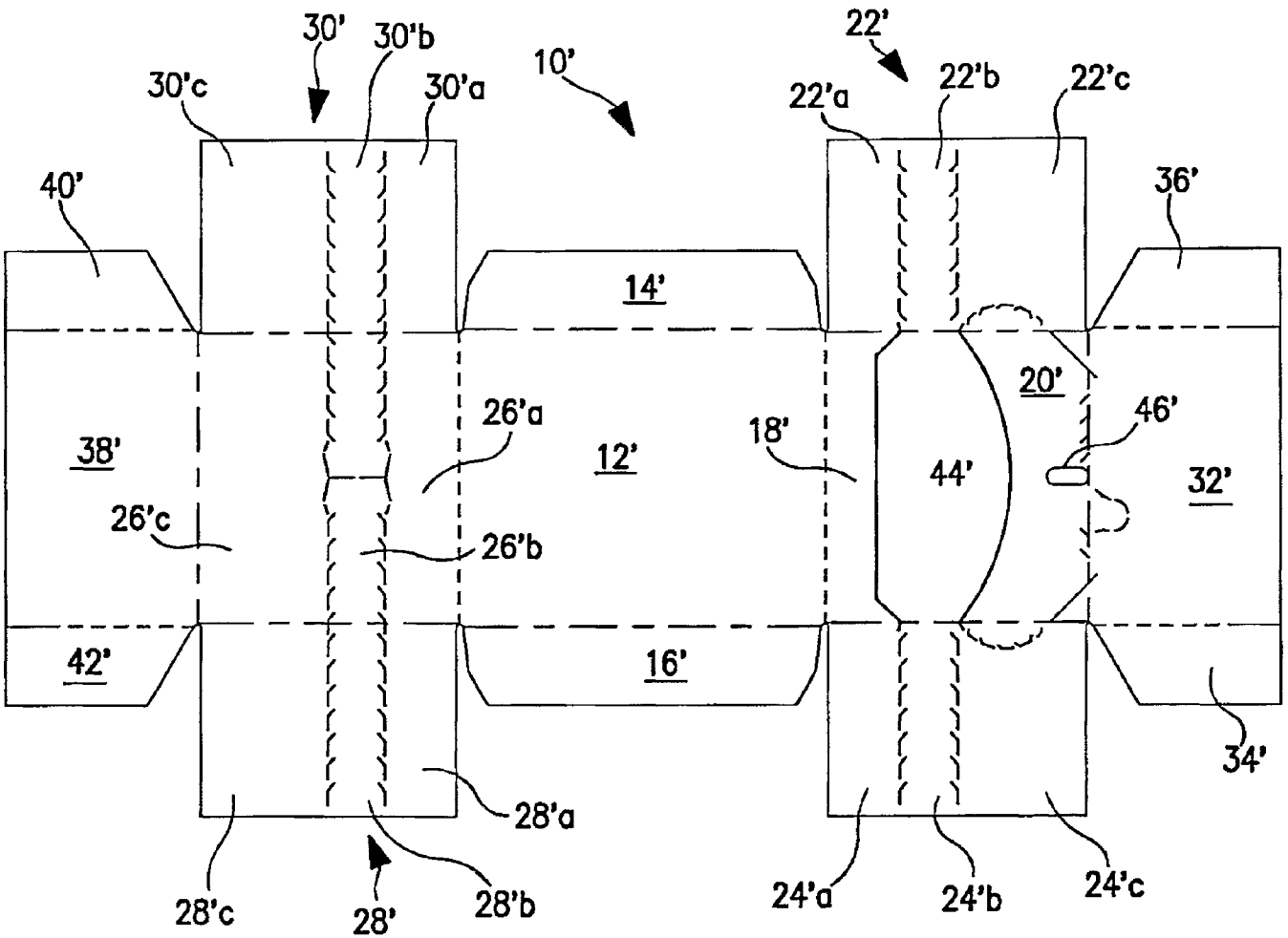
FIG. 3 is a plan view of a blank for the outer wrap portion of a convertible shipping container according to another embodiment of the invention, having zipper pull tabs associated with the front and rear side panels.

In an alternative embodiment of the invention, instead of blank 10, of FIG. 1, blank 10' of FIG. 3 may be used. In blank 10', rear tear strip panels 28'*b* and 30'*b* are provided. In FIG. 3, panels having similar structure and operation as those of blank 10 of FIG. 1 are provided with like reference numerals, augmented by a prime (').The same internal divider/structural support member using blank 50 of FIG. 2 is used.

Figures 8A, 8B, 8C, 8D:
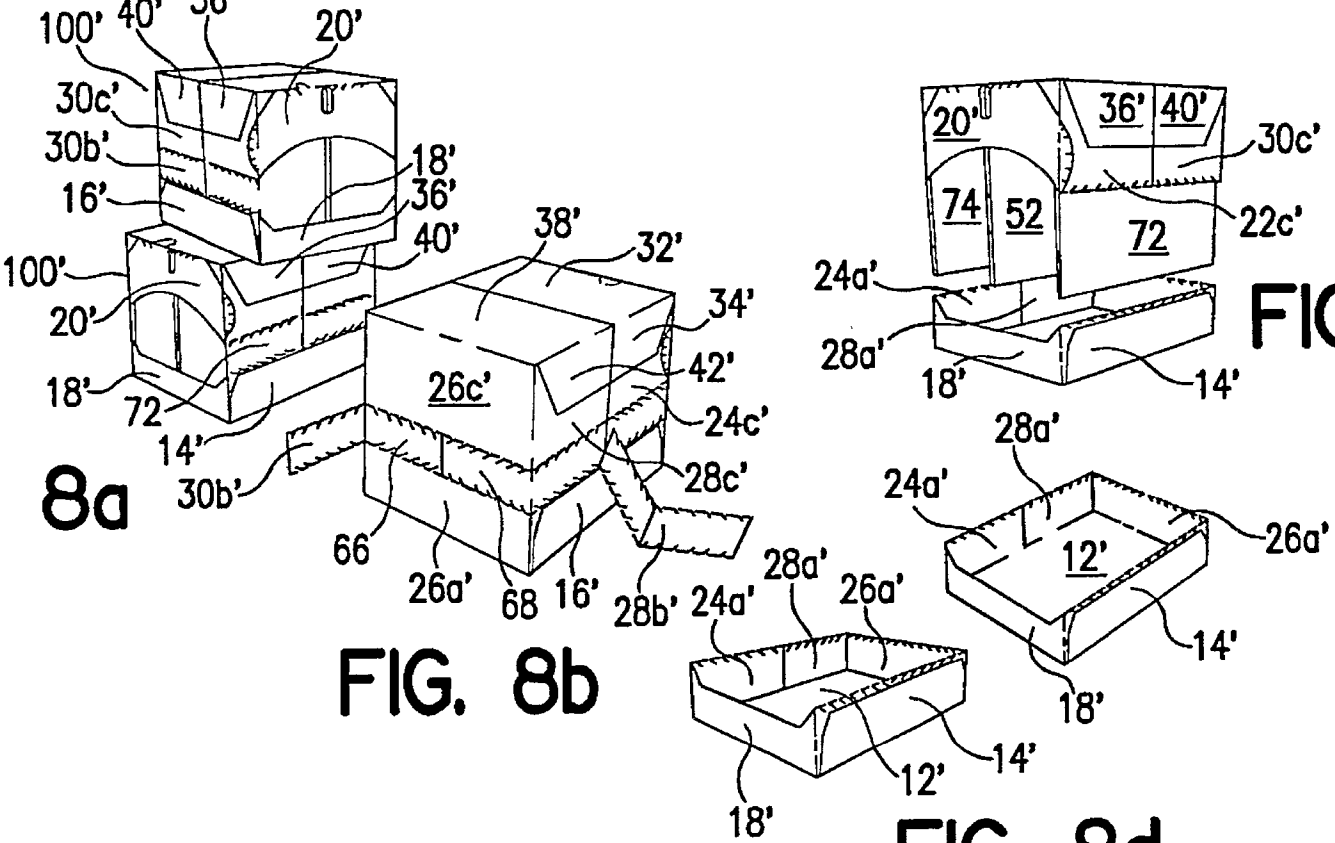
FIG. 8*a* illustrates two convertible shipping containers, according to the embodiment of FIGS. 3 and 2.
FIG. 8*b* illustrates an initial step in the conversion of a shipping container according to the embodiment of FIG. 8*a*.
FIG. 8*c* illustrates a final step in the conversion of a shipping container according to the embodiment of FIG. 8*a*, leaving an open tray.
FIG. 8*d* illustrates two views of an open tray resulting from the conversion of a convertible shipping container according to the embodiment of FIG. 8*a*.

In the embodiment of FIG. 3, the general method of forming the container is the same as with respect to the embodiment of FIGS. 1, 2, 5*a*-5*e* and 6. Care must be taken to ensure that the inside surfaces of tear strips 28'*b* and 30'*b* are not adhered to the outside surfaces of panels 72, 74 of the internal divider/structural support member. FIG. 8*a* shows containers 100', in fully erected, closed configuration. In FIG. 8*b*, a container 100' is shown from the rear, wherein tear strip panels 28'*b* and 30'*b* are shown being removed. Upon the further removal of tear strips 22'*b* and 24'*b*, the entire upper portion of the wraparound portion can be removed. If the rear portions of the upper edges of the divider/structural support member are adhered to panel 26'*c* (and possibly 20') or alternatively or in addition, the inside surfaces of the top panel(s), then the divider is removed upon removal of the "cap" portion, resulting in an open tray, holding the product, as seen in FIG. 8*c*. Such a configuration permits removal of the products from all angles around the tray. FIG. 8*d* shows two views of a tray resulting from the conversion of container 100'.

Figure 4:
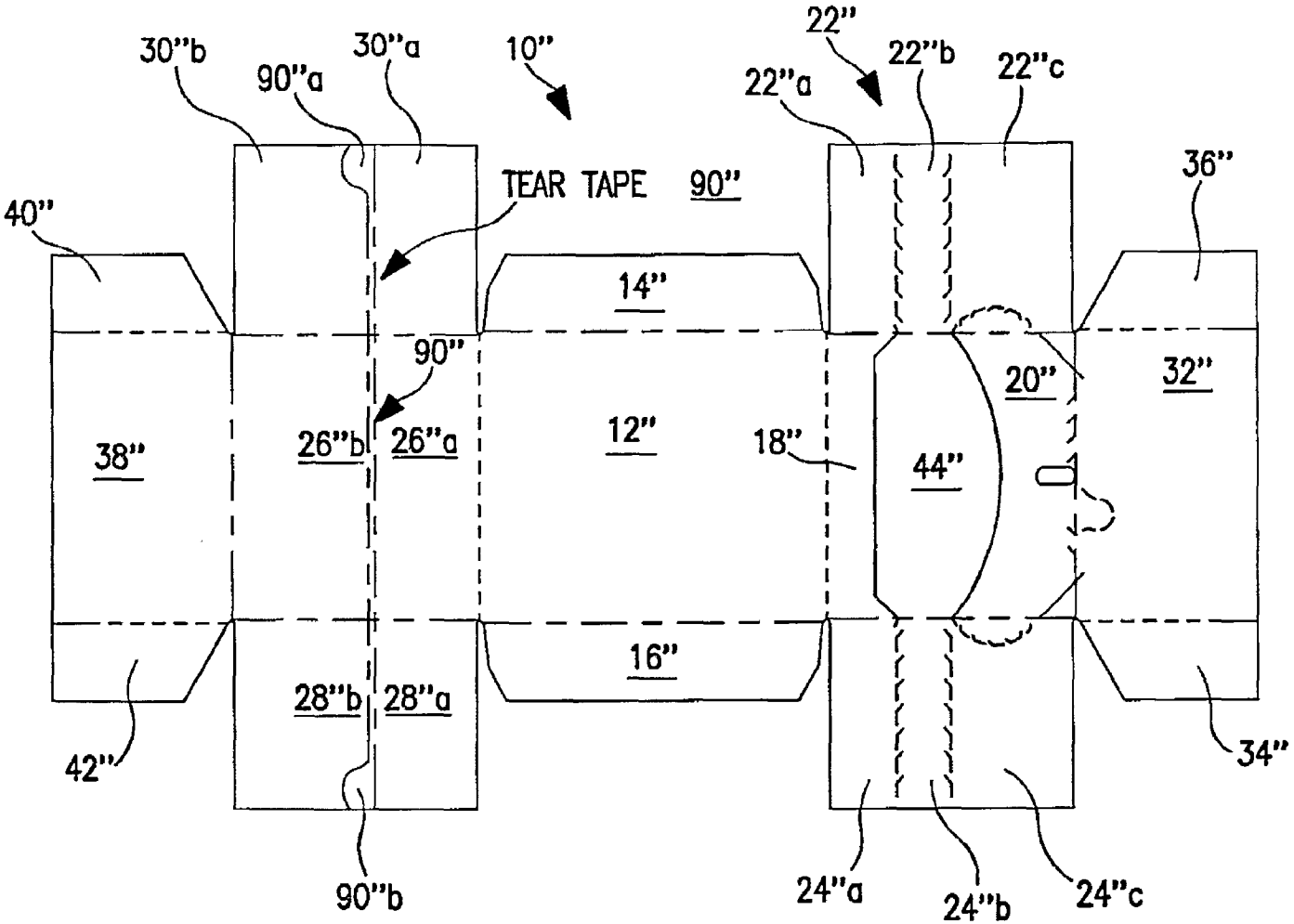
FIG. 4 is a plan view of a blank for the outer wrap portion of a convertible shipping container according to yet another embodiment of the invention, having zipper pull tabs associate with the front side panels, and a tear tap associated with the rear side panels.

A still further alternative for the wraparound portion is shown in FIG. 4, wherein blank 10" is provided. In FIG. 4, panels having similar structure and operation as those of blank 10 of FIG. 1 are provided with like reference numerals, augmented by a double prime ("). The same internal divider/structural support member using blank 50 of FIG. 2 is used. Instead of zipper pull tabs 28'*b* and 30'*b* of the embodiment of FIG. 3, an embedded tear tape 90" with end tabs 90"*a*, 90"*b*, is provided. The possible modes of operation of the container resulting from blank 10" are substantially the same as those of the container 100' resulting from blank 10' of FIG. 3.

Figure 9:
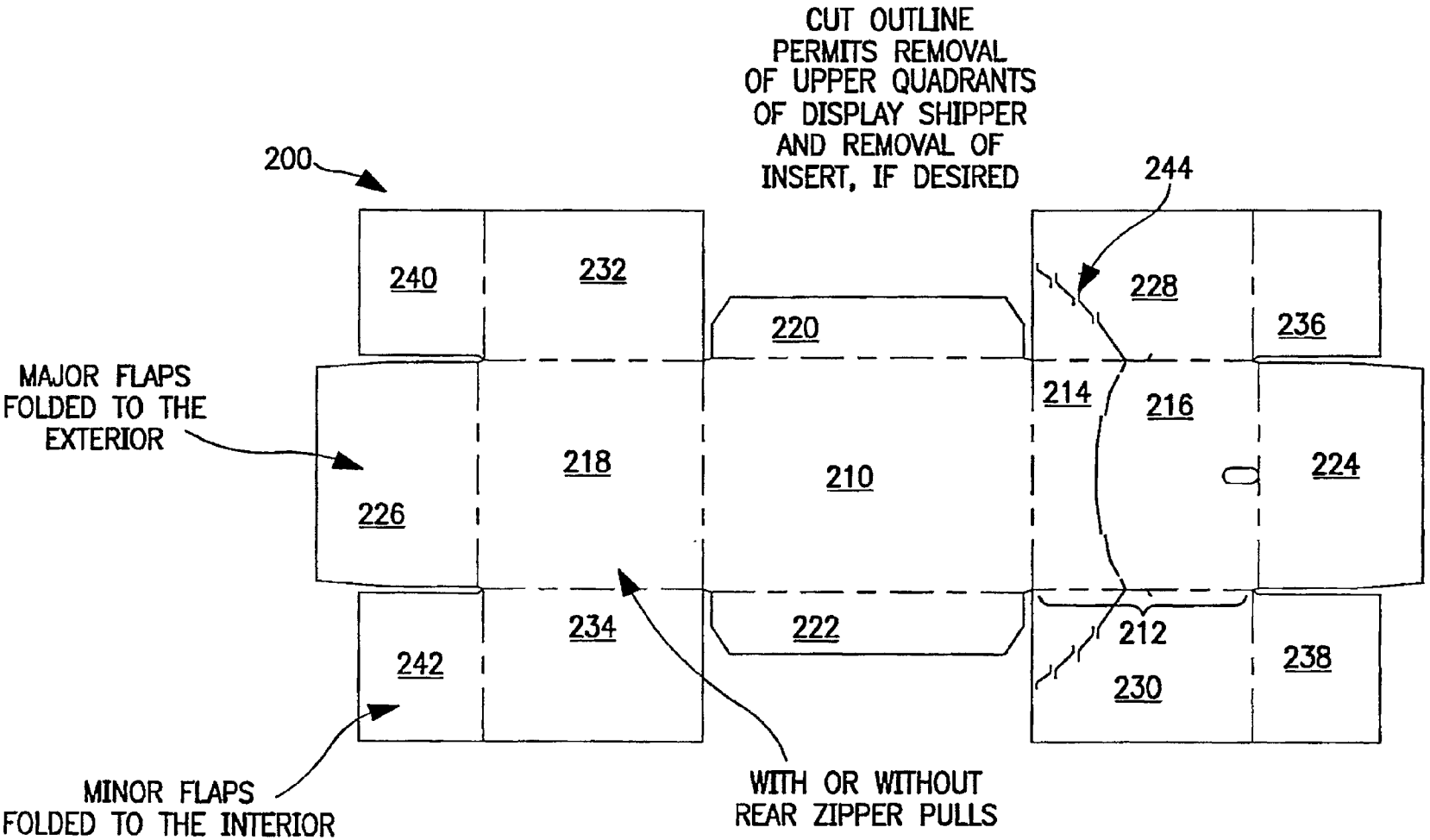
FIG. 9 is a plan view of a blank for the outer wrap for a convertible shipping container according to another embodiment of the invention.
Figure 10:
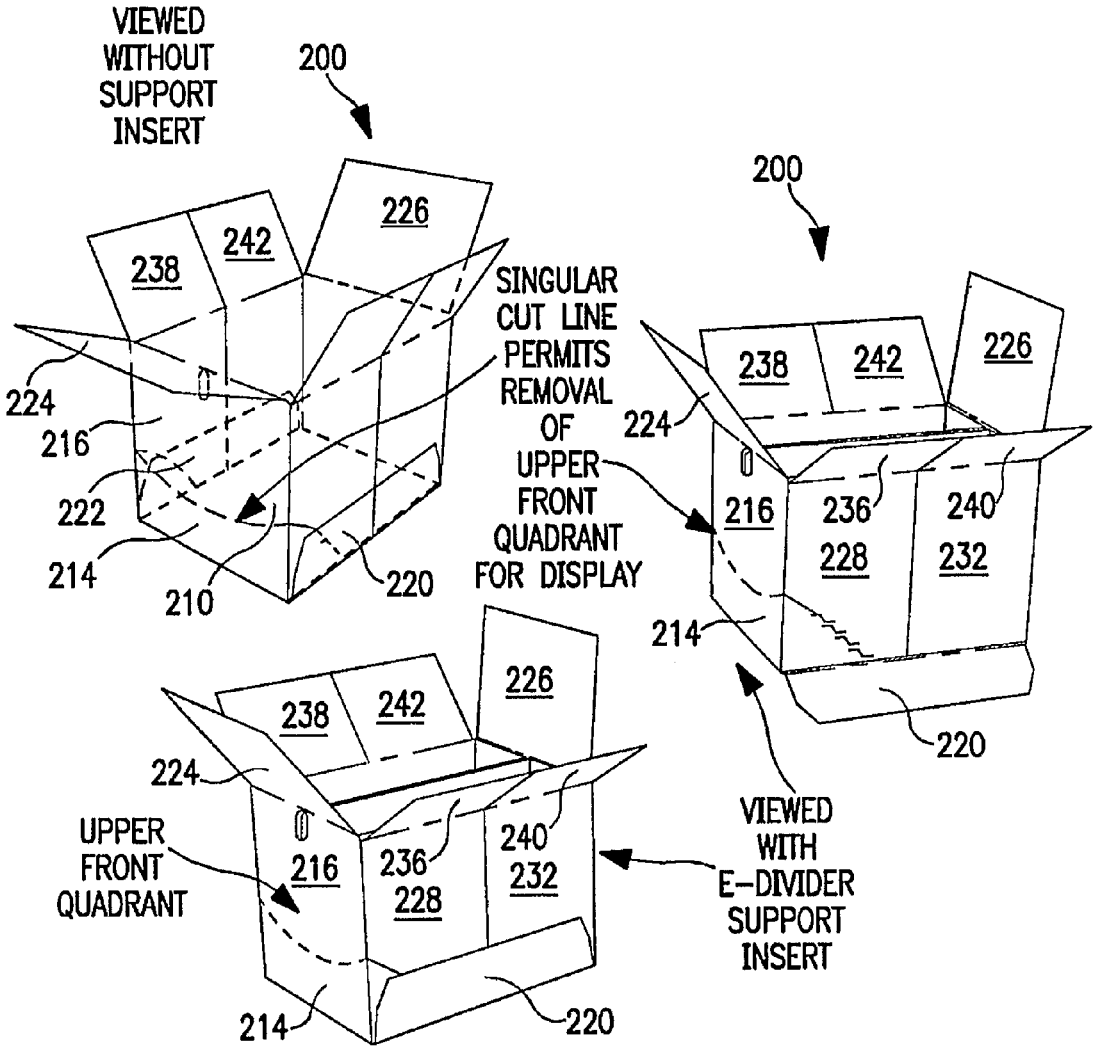
FIG. 10 comprises perspective views of the convertible shipping container according to the embodiment of FIG. 9.

FIG. 9 is a plan view of a blank for the outer wrap for a convertible shipping container according to another embodiment of the invention, which differs from the embodiment of FIGS. 1-8*d*, in that instead of panels extending downwardly from the sides of the top panels, additional top panels emanate from the top edges of the side panels. FIG. 10 comprises perspective views of the convertible shipping container according to the embodiment of FIG. 9. Blank 200 includes bottom wall 210; front wall 212 (including front lower panel 214 and front upper panel 216); rear wall 218; bottom side panels 220 and 222; front top panel 224; rear top panel 226; front side panels 228 and 230; rear side panels 232 and 234; front side top panels 236 and 238; and rear side top panels 240 and 242. A cut outline 244, extending across wall 212, and panels 228 and 230 permits removal of upper quadrants of the convertible shipping container, as well as of the internal support/divider. Blank 200 is erected in a manner similar to that of the prior embodiments, except that alternative top minor panels are provided (which are folded to the inside of the front and rear top panels) that provide a common top closure, that can be either glued or taped, and which is amenable to operation on otherwise conventional major and minor top flap case sealing equipment.

Figure 11:
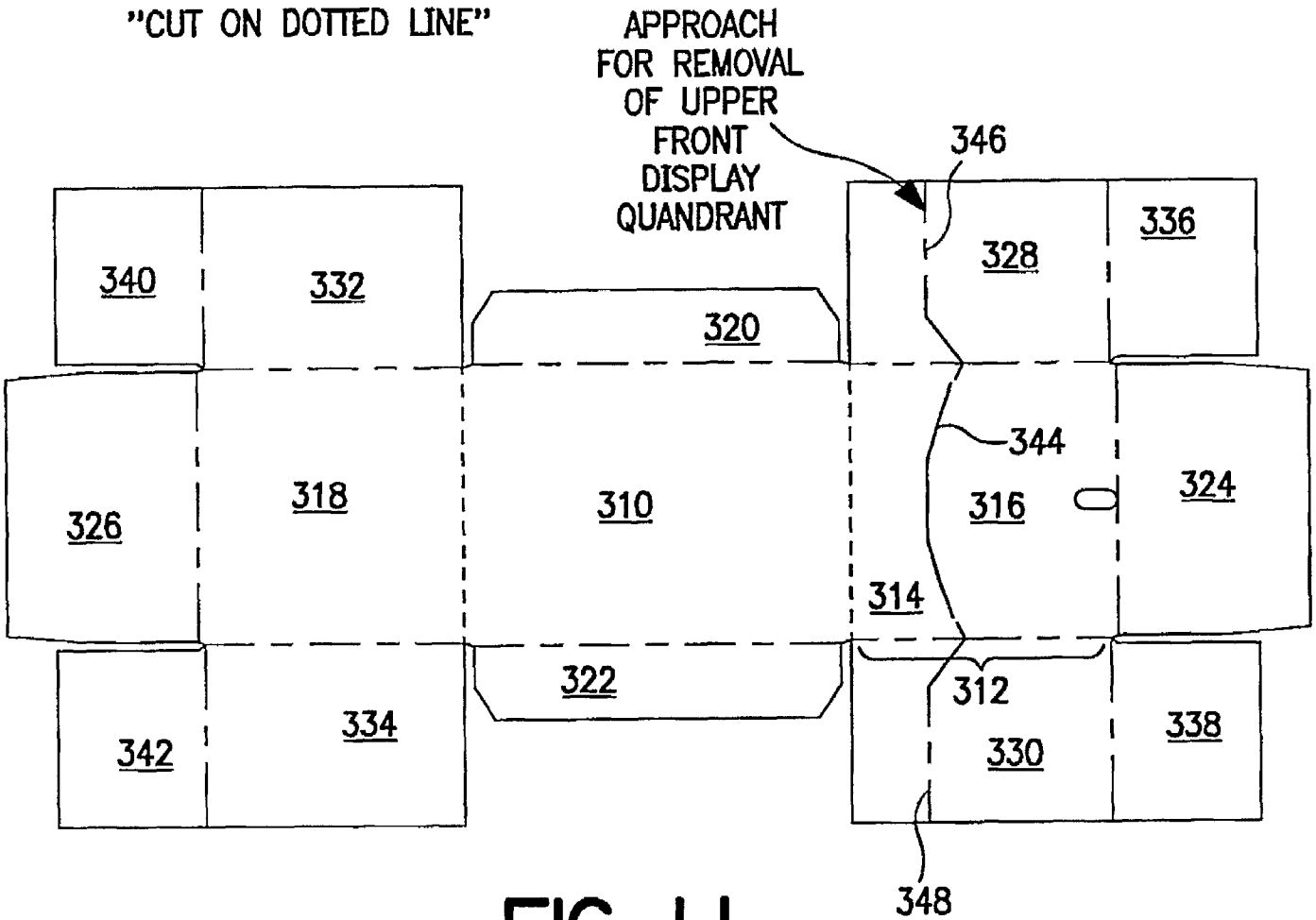
FIG. 11 is a plan view of a blank for the outer wrap for a convertible shipping container according to another embodiment of the invention.
Figure 12:
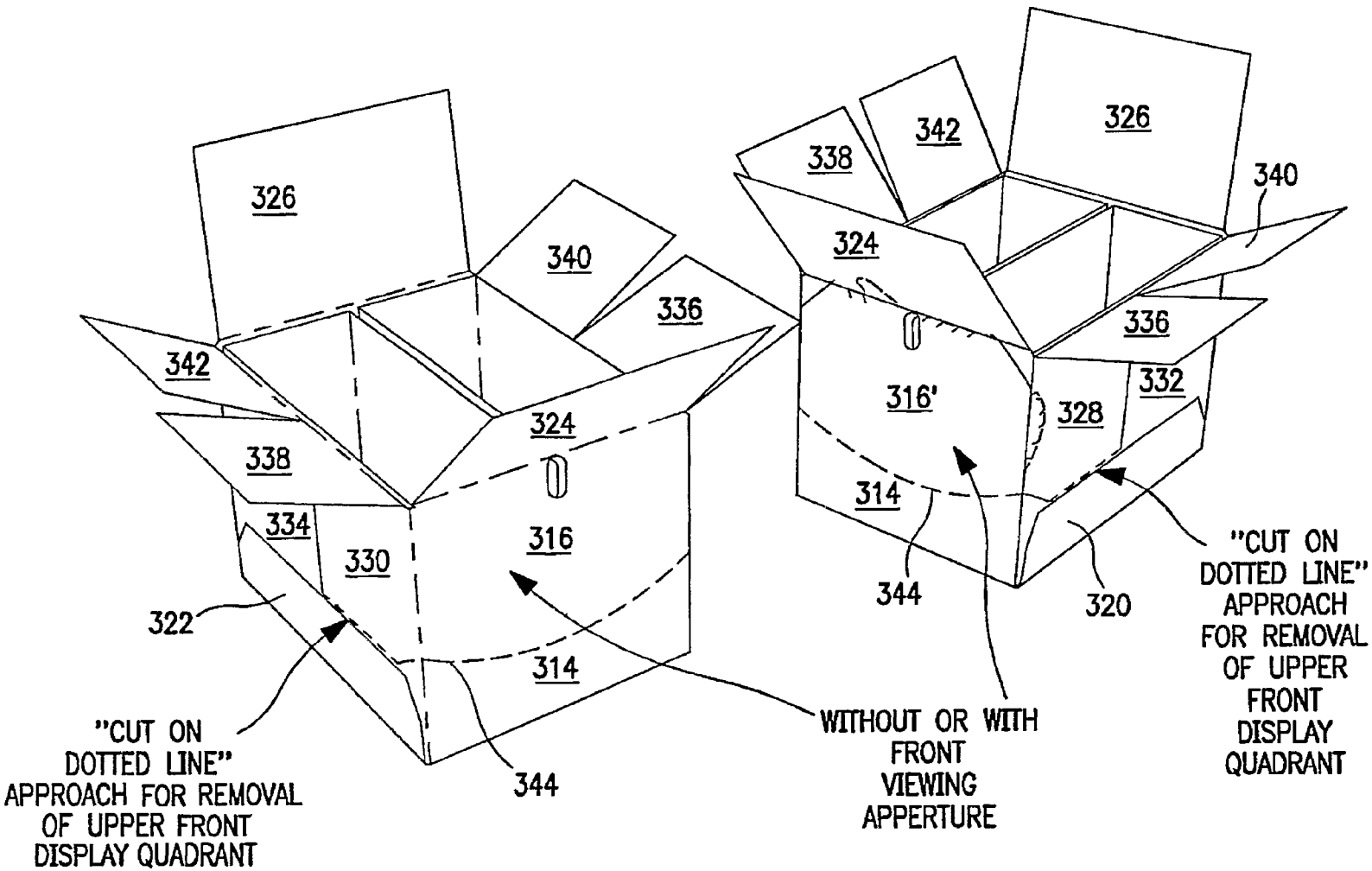
FIG. 12 comprises perspective views of the convertible shipping container according to the embodiment of FIG. 11.

FIG. 11 is a plan view of a blank for the outer wrap for a convertible shipping container according to another embodiment of the invention. FIG. 12 comprises perspective views of the convertible shipping container according to the embodiment of FIG. 11. Blank 300 includes bottom wall 310; front wall 312 (including front lower panel 314 and front upper panel 316); rear wall 318; bottom side panels 320 and 322; front top panel 324; rear top panel 326; front side panels 328 and 330; rear side panels 332 and 334; front side top panels 336 and 338; and rear side top panels 340 and 342. A cut outline 344, extending across wall 312, and into, but not completely across panels 328 and 330 permits removal of upper quadrants of the convertible shipping container, as well as of the internal support/divider. "Dotted lines" 346, 348, which may be perforations, or even simply markings on the outside surfaces of blank 300 may be provided, to prompt persons to manually complete the severing of the upper portions from the lower portions, initiated by cut line 344. Blank 300 is erected in a manner similar to that of the prior embodiments, except that alternative top minor panels are provided (which are folded to the inside of the front and rear top panels) that provide a common top closure, that can be either glued or taped, and which is amenable to operation on otherwise conventional major and minor top flap case sealing equipment.

Figure 13:
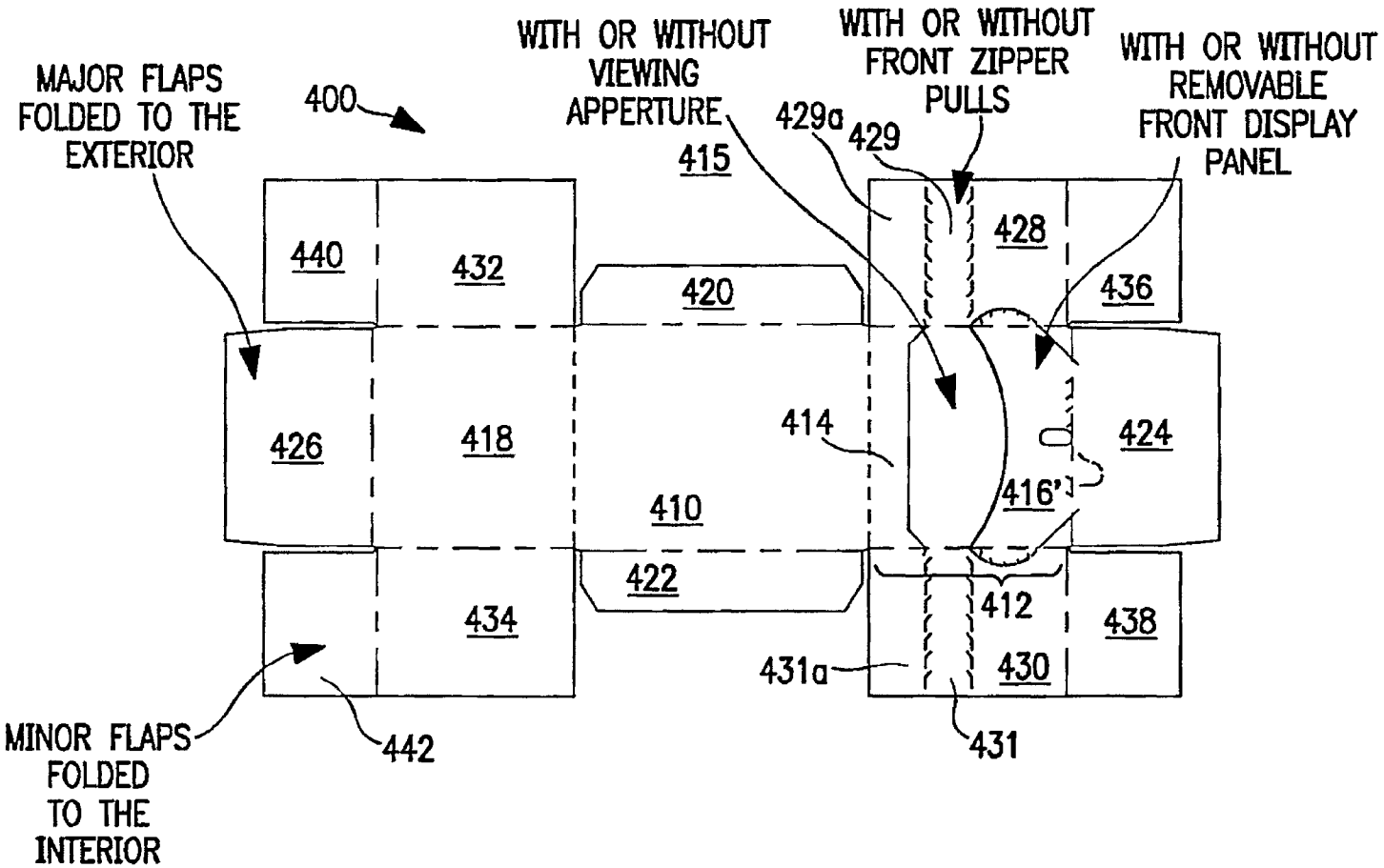
FIG. 13 is a plan view of a blank for the outer wrap for a convertible shipping container according to another embodiment of the invention.
Figure 14:
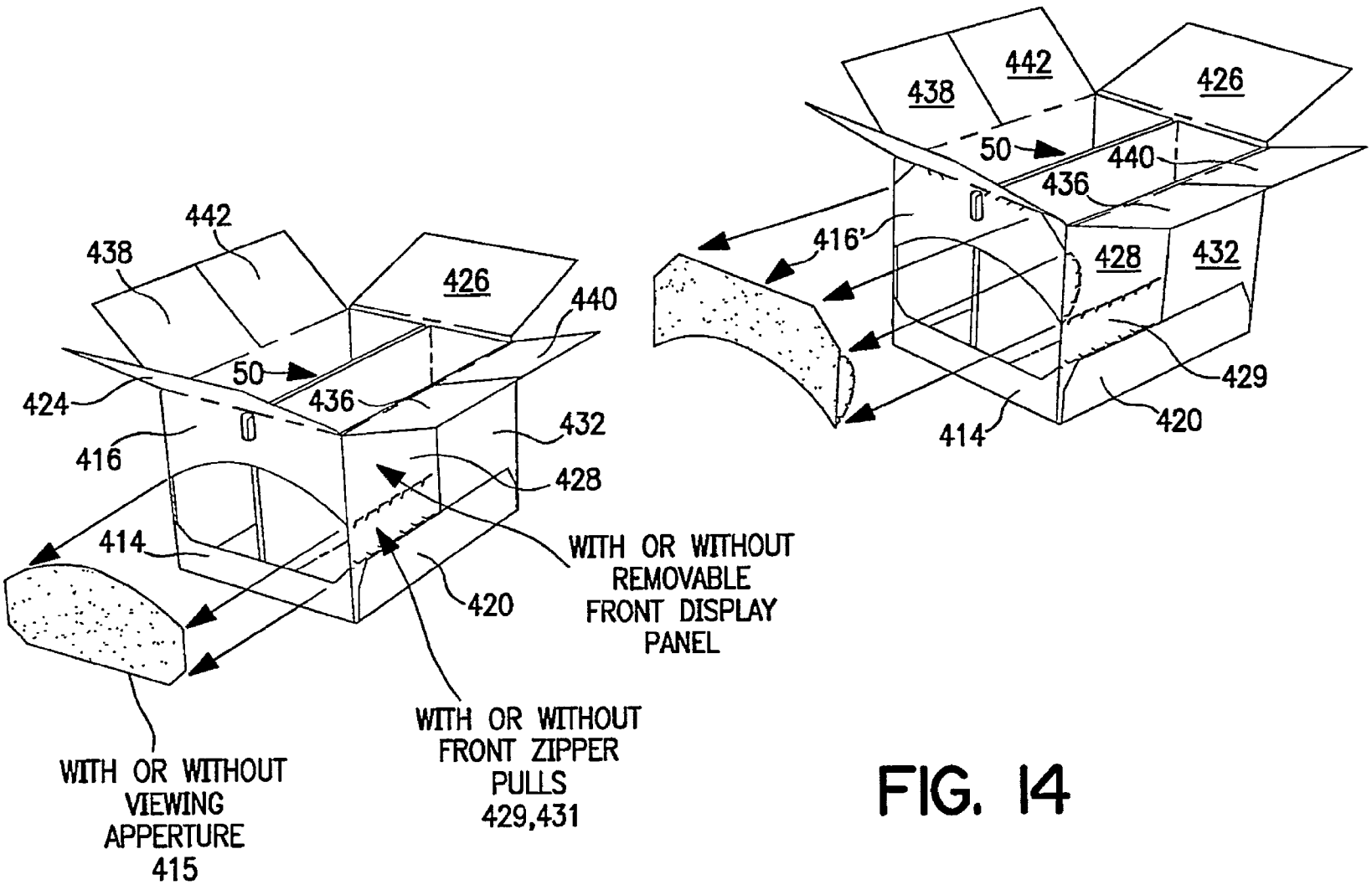
FIG. 14 comprises perspective views of the convertible shipping container according to the embodiment of FIG. 13.

FIG. 13 is a plan view of a blank for the outer wrap for a convertible shipping container according to another embodiment of the invention. FIG. 14 comprises perspective views of the convertible shipping container according to the embodiment of FIG. 13. Blank 400 includes bottom wall 410; front wall 412 (including front lower panel 414 and front upper panel 416); rear wall 418; bottom side panels 420 and 422; front top panel 424; rear top panel 426; front side panels 428 and 430; rear side panels 432 and 434; front side top panels 436 and 438; and rear side top panels 440 and 442. Blank 400 may or may not be provided with viewing aperture 415, and may or may not be provided with a removable face panel 416' (which may be configured similarly to panel 20, of the embodiment of FIG. 1). If panel 416' is not provided, a panel 416 may be provided instead (see FIG. 14). Zipper pull tabs 429, 431 may be provided, to permit removal of the front upper quadrant of the container, in a manner similar to that illustrated and described with respect to the embodiment of FIG. 1. Blank 400 is erected in a manner similar to that of the prior embodiments, except that alternative top minor panels are provided (which are folded to the inside of the front and rear top panels) that provide a common top closure, that can be either glued or taped, and which is amenable to operation on otherwise conventional major and minor top flap case sealing equipment.

Figure 15:
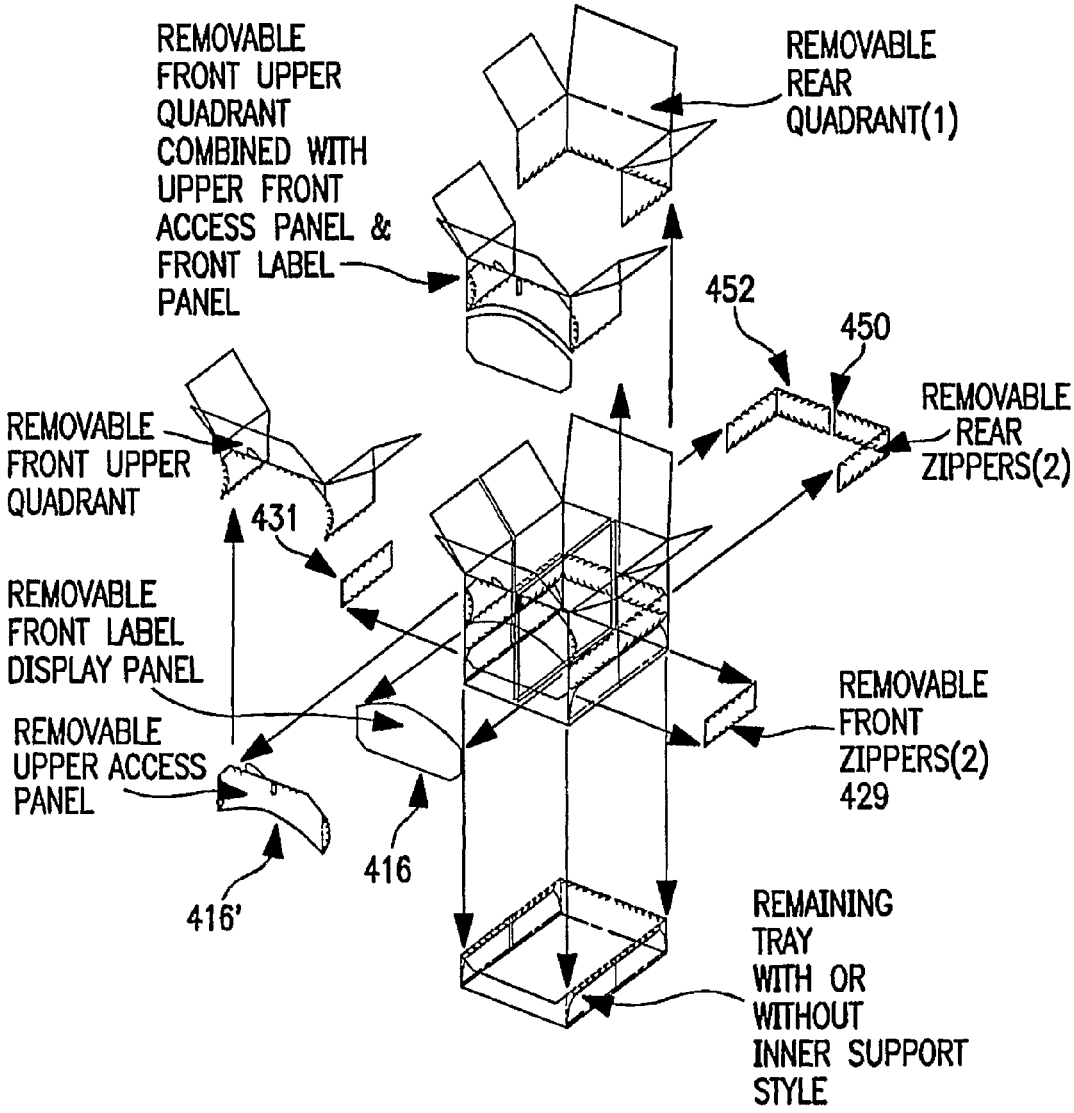
FIG. 15 is a perspective "exploded" view of a convertible shipping container, according to the embodiments of FIGS. 9-14, illustrating for comparison purposes, the various different conversion features from those embodiments.

FIG. 15 is a perspective "exploded" view of a convertible shipping container, according to the embodiments of FIGS. 9-14, which is not intended to illustrate any one embodiment, but instead illustrates, for comparison purposes, the various different conversion features from those embodiments.

In each of the embodiments of FIGS. 9-15, as in the embodiments of FIGS. 1-8*d*, removable panels (e.g., 316' of FIG. 12) creating viewing apertures (e.g., aperture 415 of FIG. 13) may be provided in the front walls; and rear/side zipper pulls (e.g., 450, 452 of FIG. 15) or inner or embedded tear strings may also be provided, if desired, to permit removal of the entire upper structure, to result in a tray, as shown in FIG. 15.

Figure 16:
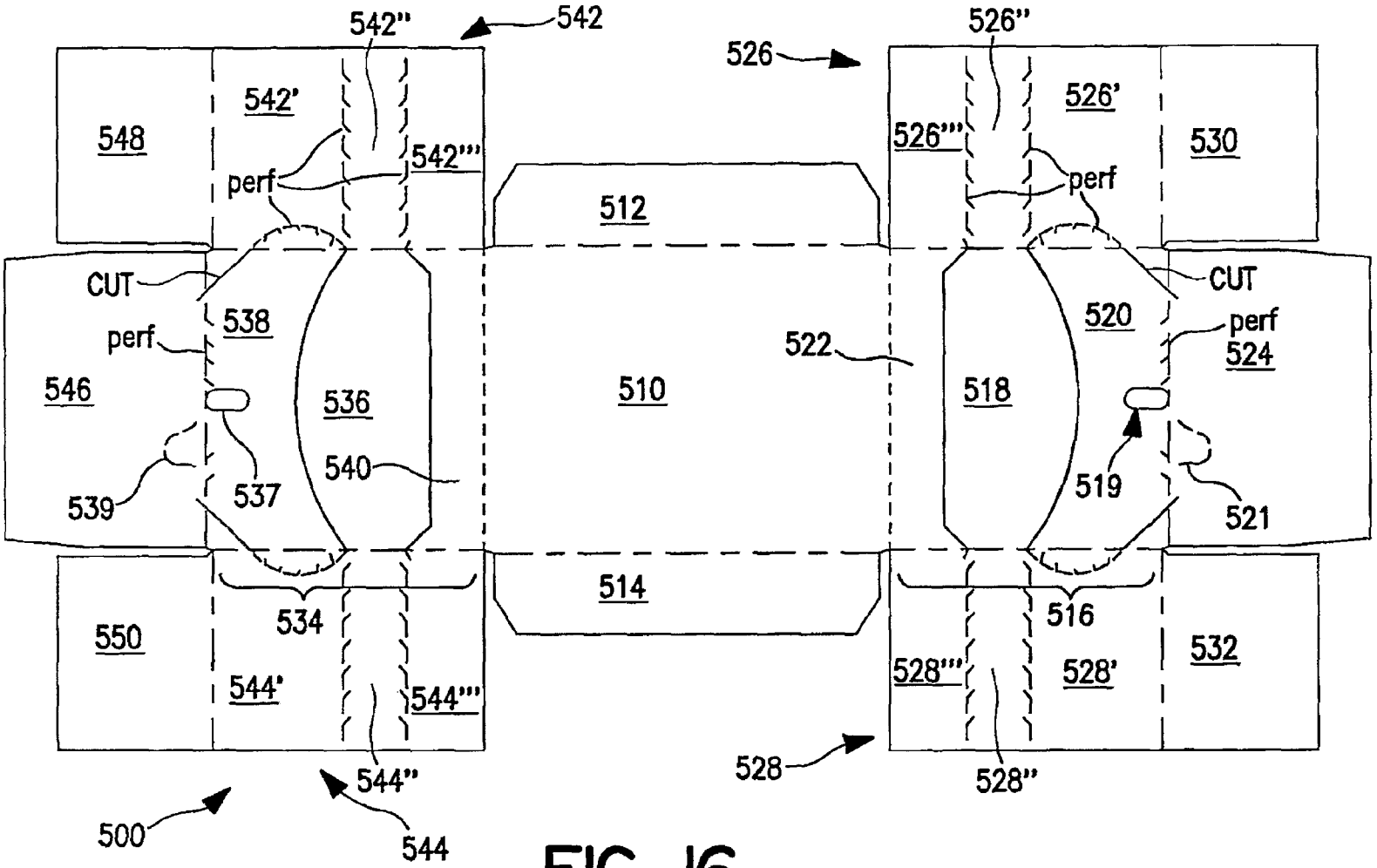
FIG. 16 is a plan view of a blank for an outer wrap for a convertible shipping container according to another alternative embodiment of the invention.
Figure 17:
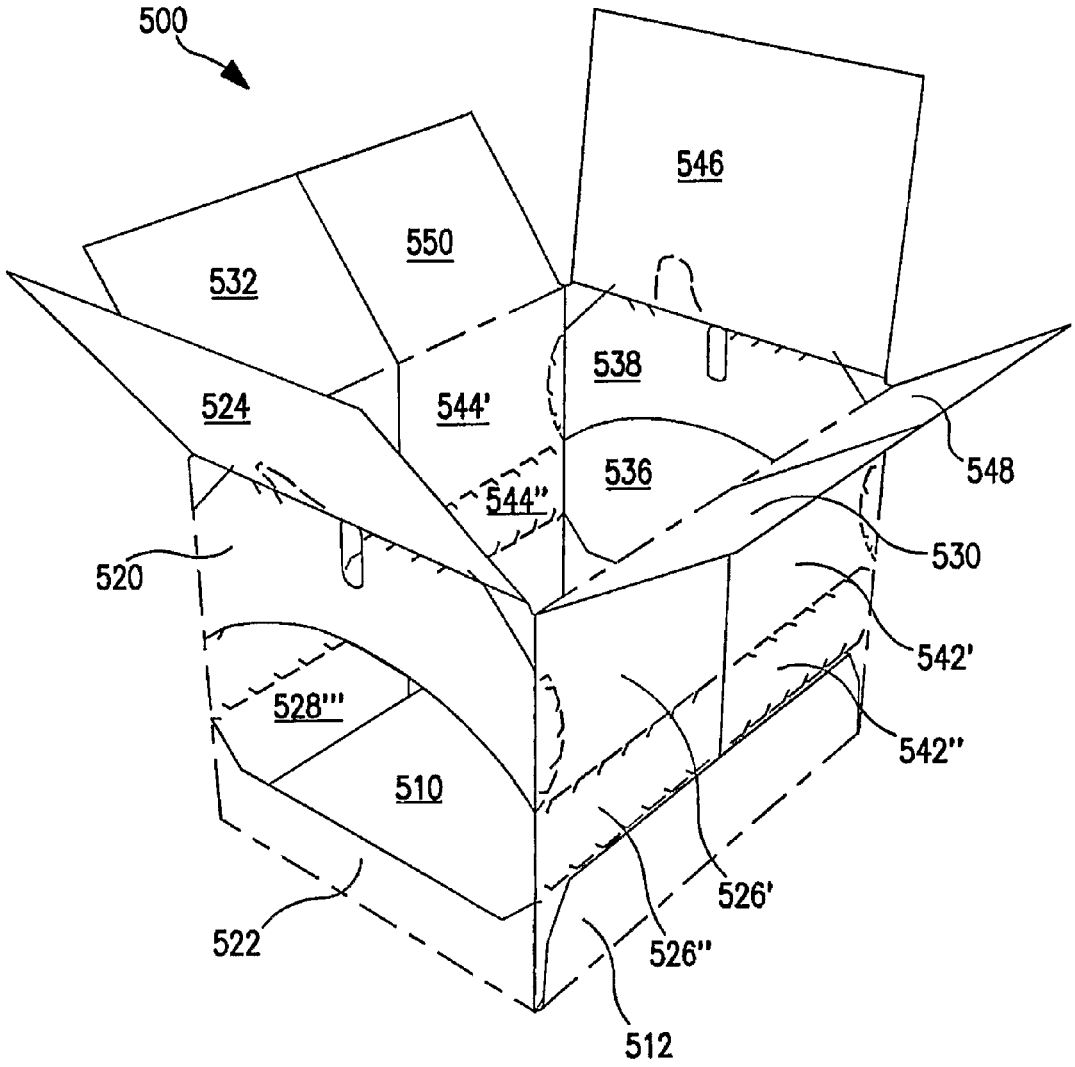
FIG. 17 is a perspective view of an erected outer wrap for the convertible shipping container according to the embodiment of FIG. 16.

FIG. 16 illustrates a blank for another embodiment of the invention, similar to the embodiments of FIGS. 9-15, but with viewing openings and removable face panels on both the front and rear walls. Blank 500 includes bottom panel 510; bottom side panels 512, 514; front wall 516, with opening 518, face panel 520 and lower panel 522; front top panel 524; front side panels 526 and 528, with top portions 526', 528', zipper pull tabs 526", 528", and bottom portions 526'", 528'"; front side top panels 530, 532; rear wall 534, with opening 536, face panel 538 and lower panel 540; rear side panels 542, 544, with top portions 542', 544', zipper pull tabs 542", 544", and lower portions 542'", 544'"; rear top panel 546, and rear side top panels 548, 550. Also included are slots 519, 537, for receiving tabs from the internal support/divider, as well as perforated tabs 521, 539, for facilitating removal of face panels 520, 538. Face panels 520, 538 are preferably configured similar to face panel 20 of the embodiment of FIG. 1, and operates in a substantially similar manner. An erected container 500 is illustrated in FIG. 17.

Figure 18:
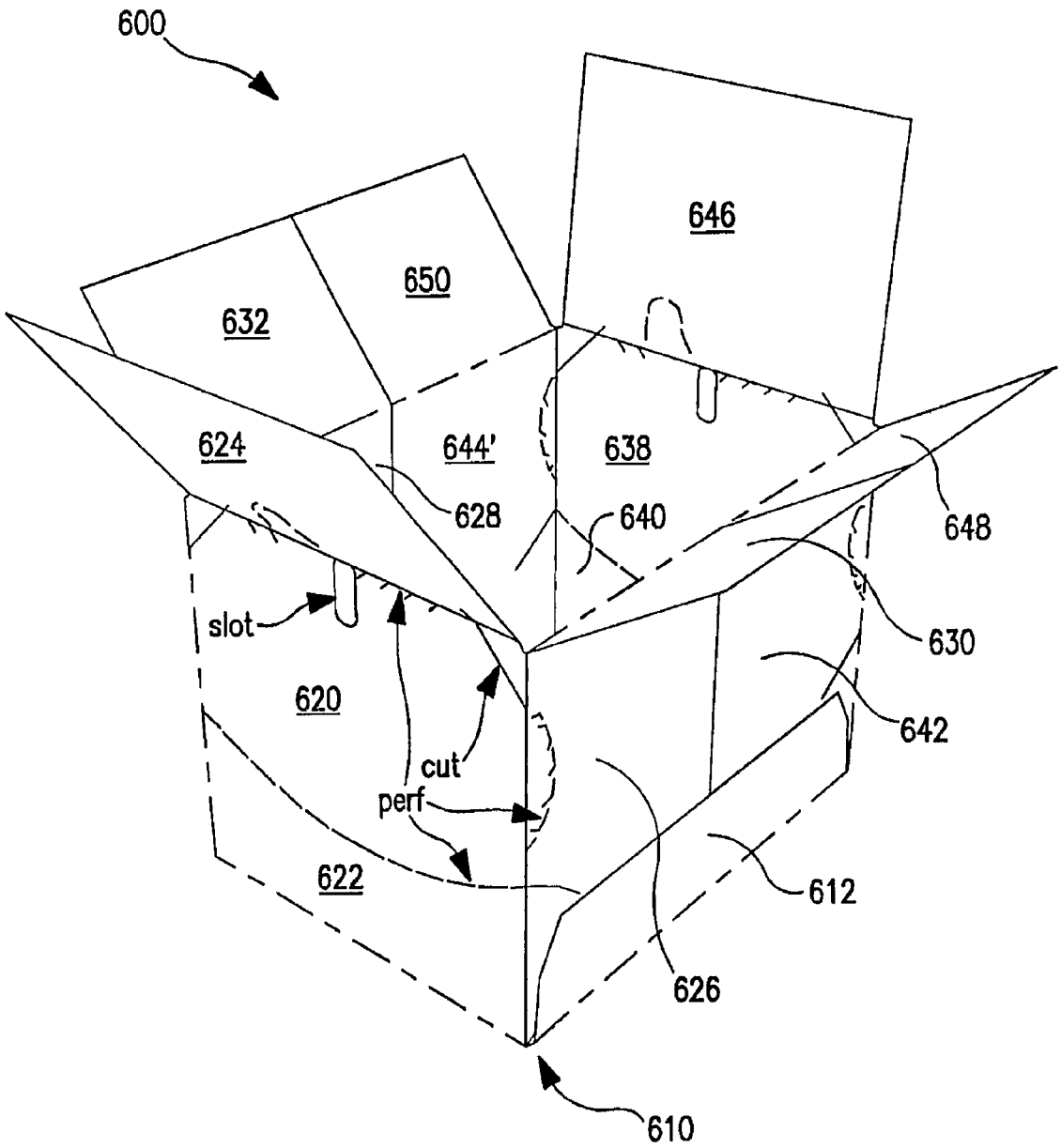
FIG. 18 is a perspective view of an erected outer wrap for a convertible shipping container according to another alternative embodiment.

FIG. 18 illustrates an erected container 600, which is substantially similar to container 500, except that the viewing openings and the zipper pull tabs are omitted. Container 600 includes bottom wall 610, bottom wall 612, face panels 620, 638; lower panels 622, 640; front side panels 626, 628; rear side panels 642, 644; front side top panels 630, 632; and rear side top panels 648, 650. Face panels 620, 638 are constructed and operate in a substantially similar manner as face panels 520, 538 of the embodiment of FIGS. 16, 17.

Figure 19:
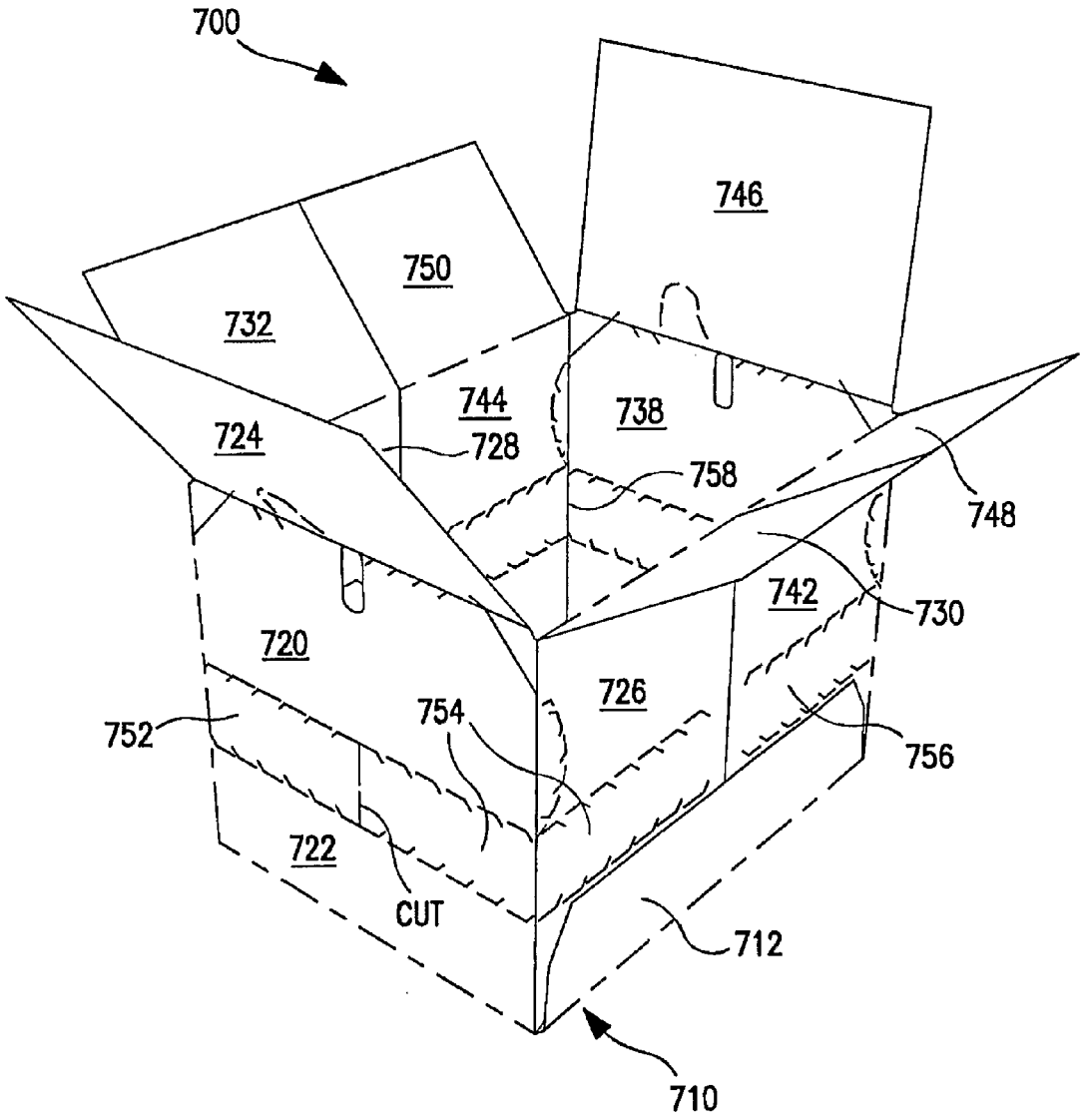
FIG. 19 is a perspective view of an erected outer wrap for a convertible shipping container according to another alternative embodiment.

FIG. 19 illustrates an erected container 700, which is substantially similar to container 500, except that the viewing openings have been omitted, and zipper pull tabs have been provided that completely encircle the container. Container 700 includes bottom wall 710, bottom wall 712, face panels 720, 738; lower panels 722, 740; front side panels 726, 728; rear side panels 742, 744; front side top panels 730, 732; and rear side top panels 748, 750. Face panels 720, 738 are constructed and operate in a substantially similar manner as face panels 520, 538 of the embodiment of FIGS. 16, 17. Container 700 also includes zipper pull tabs 752, 754, 756 and 758, each of which extends around a "corner" of container 700, and is defined by upper and lower parallel perforation lines.

In addition to variations in the blanks forming the outer wrappers, the present invention also contemplates variations in the configuration of the internal support/divider structures. FIGS. 20-34 illustrate several alternative internal support/divider structures.

Figure 20:
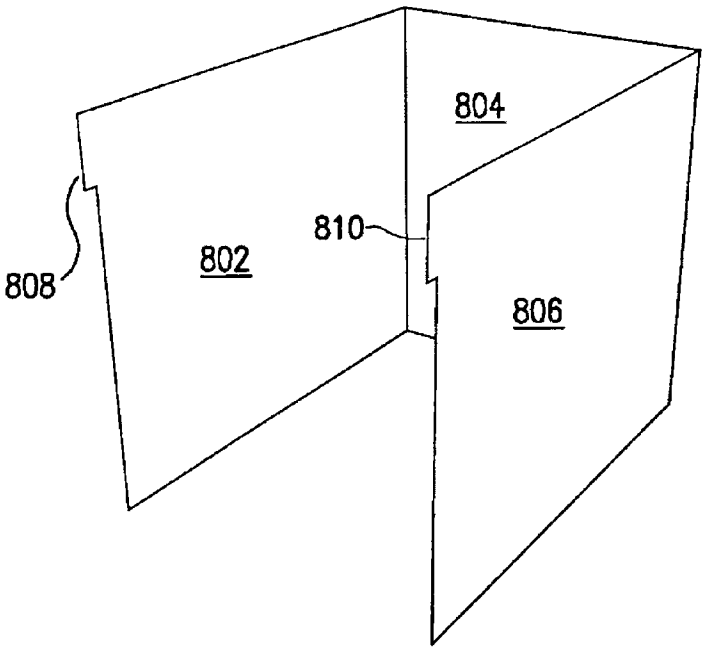
FIG. 20 is a perspective view of an erected support divider for a convertible shipping container according to another alternative embodiment.
Figure 21:
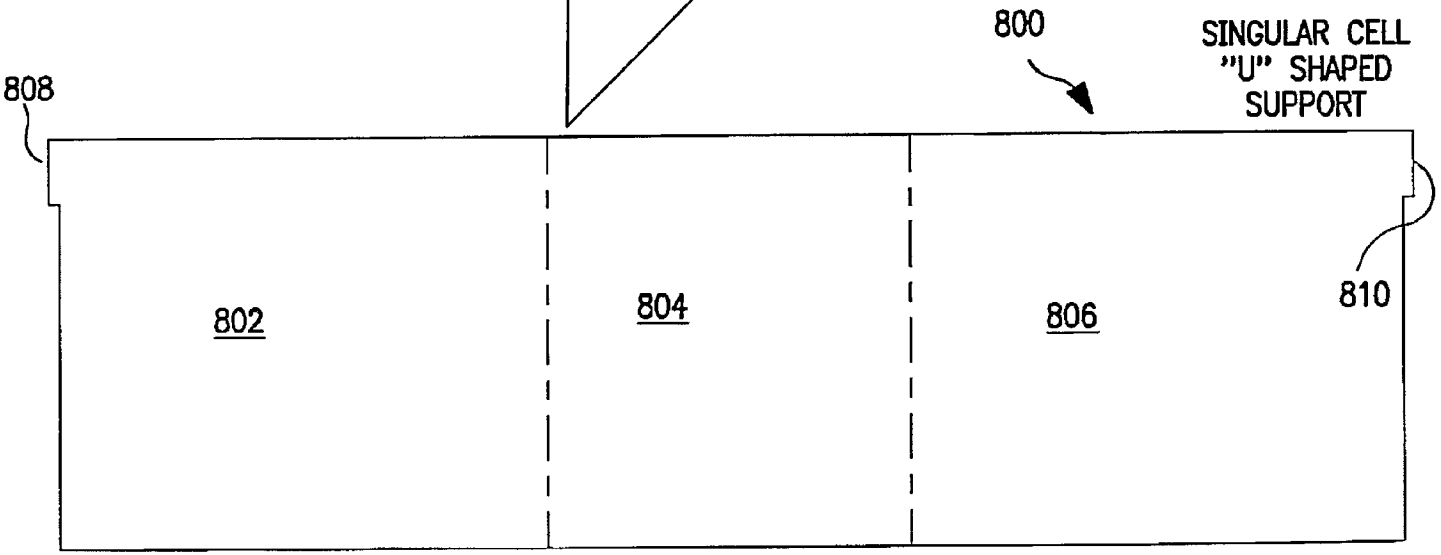
FIG. 21 is a plan view of the blank for the support divider for the outer wrap for the embodiment of FIG. 20.

FIGS. 20-21 illustrate a simple singular cell "U" shaped internal support structure 800, which is formed by three panels 802, 804, 806, and include positioning tabs 808, 810, which will be received in suitably located slots (not shown) in the face panel of any of the embodiments shown or described herein.

Figure 23:
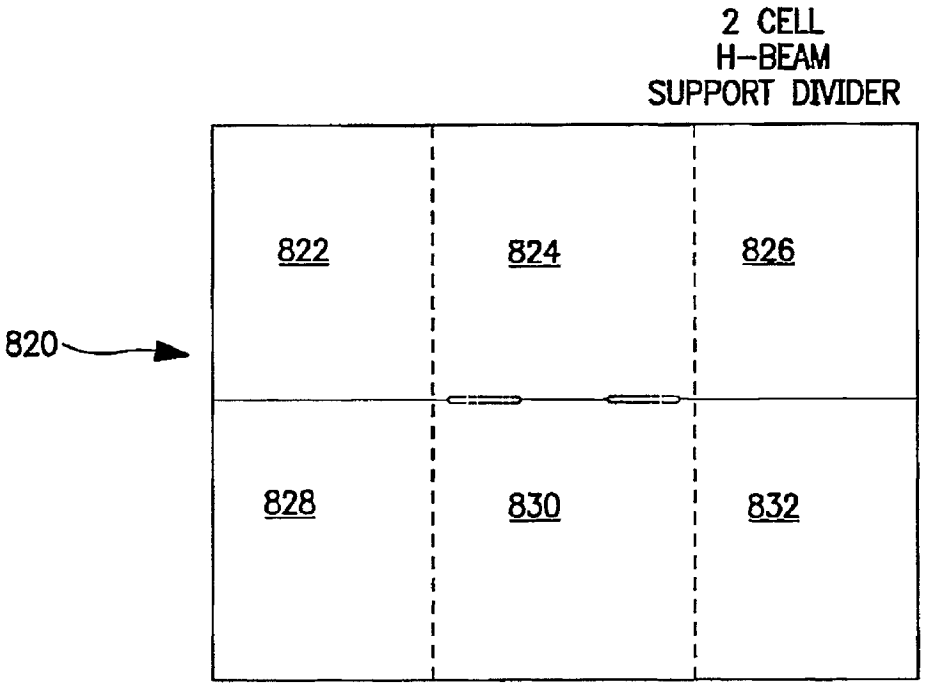
FIG. 23 is a plan view of the blank for the support divider for the outer wrap for the embodiment of FIG. 22.
Figure 22:
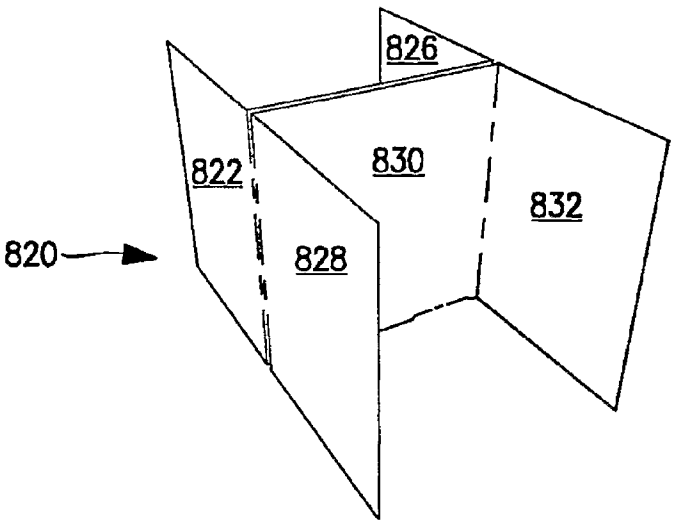
FIG. 22 is a perspective view of an erected support divider for a convertible shipping container according to another alternative embodiment.

FIGS. 22-23 illustrate a symmetrical 2-cell H-beam support divider 820, which is formed by panels 822, 824, 826, 828, 830, 832. No positioning tabs are provided in the embodiment illustrated, although such tabs could be provided if necessary or desired, in accordance with the requirements of a particular application.

Figure 24:
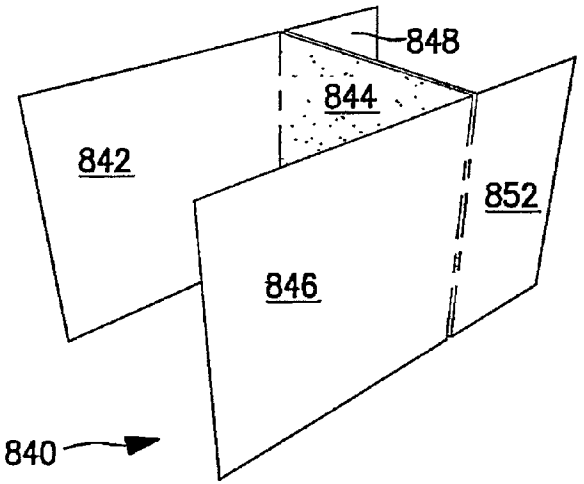
FIG. 24 is a perspective view of an erected support divider for a convertible shipping container according to another alternative embodiment.
Figure 25:
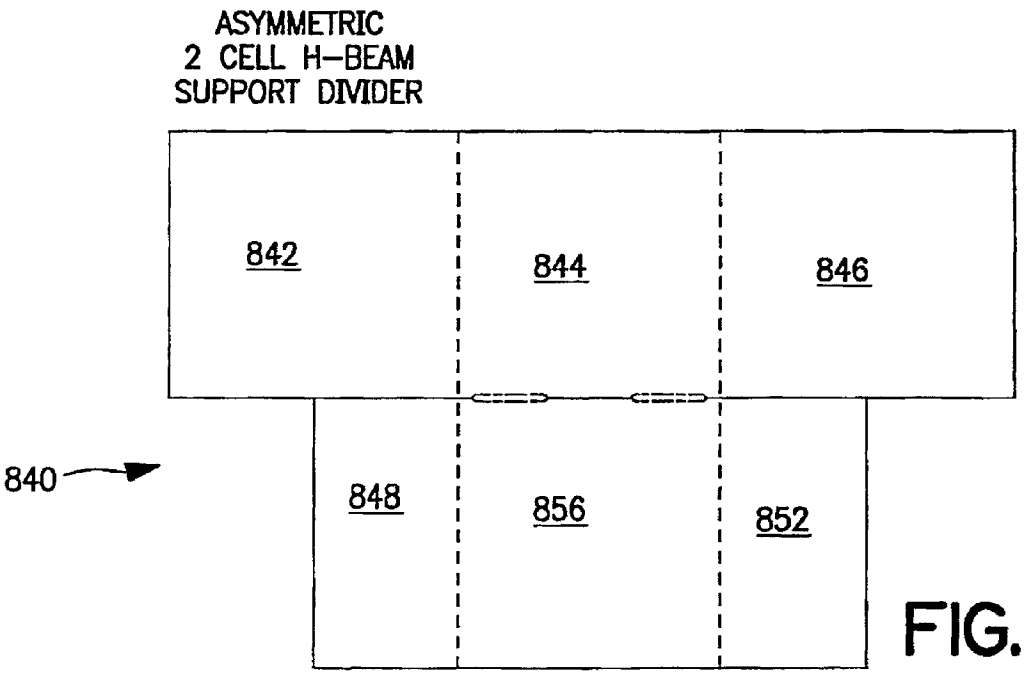
FIG. 25 is a plan view of the blank for the support divider for the outer wrap for the embodiment of FIG. 24.

FIGS. 24-25 illustrate an asymmetrical 2-cell H-beam support divider 840, which is formed by panels 842, 844, 846, 848, 850, 852. No positioning tabs are provided in the embodiment illustrated, although such tabs could be provided if necessary or desired, in accordance with the requirements of a particular application.

Figure 26:
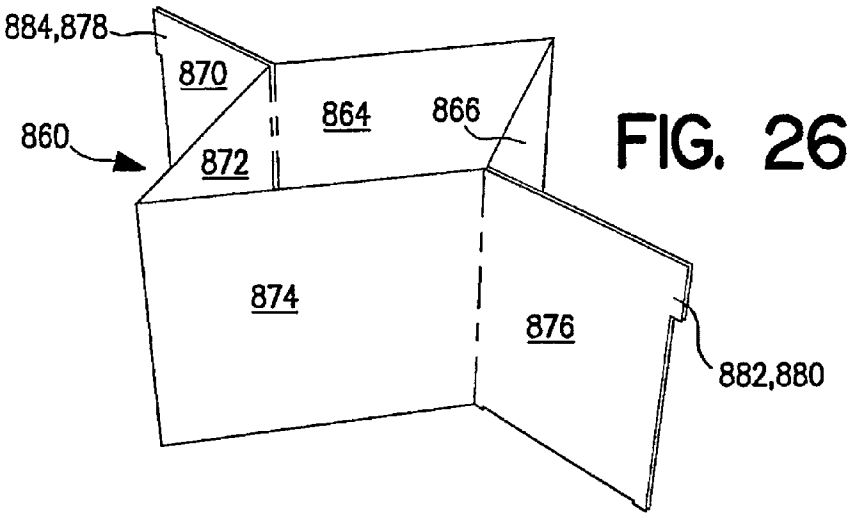
FIG. 26 is a perspective view of an erected support divider for a convertible shipping container according to another alternative embodiment.
Figure 27:
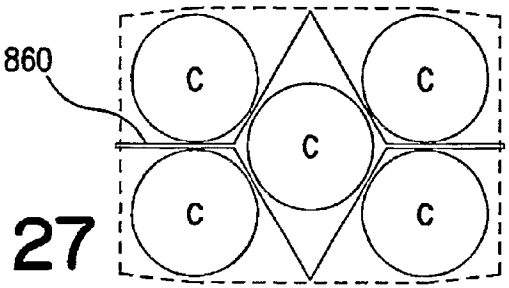
FIG. 27 is a top plan view of the erected support divider for the embodiment of FIG. 26.
Figure 28:
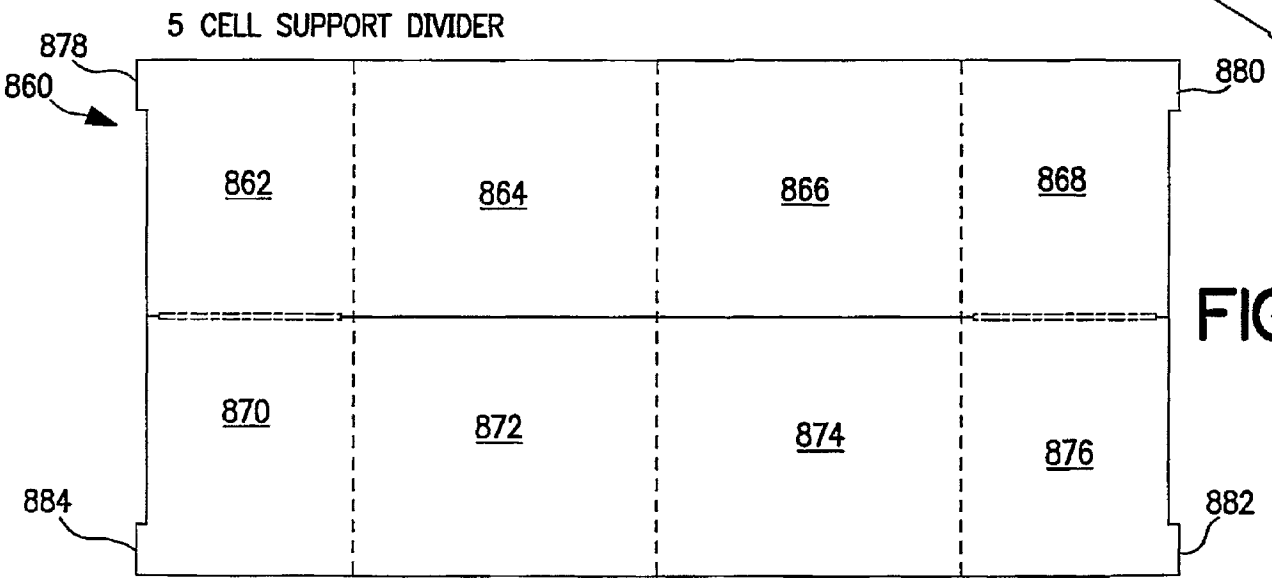
FIG. 28 is a plan view of the blank for the support divider for the outer wrap for the embodiment of FIG. 20.

FIGS. 26-28 illustrate a 5-cell support divider 860 having a diamond-shaped internal cell, which is formed by panels 862,

864, 866, 868, 870, 872, 874, 876. Positioning tabs 878, 880, 882, 884 are provided which will be received by appropriately positioned slots in panels in opposite side of an outer wrap, such as in opposing front and rear face panels. FIG. 27 illustrates in particular, a view of above, of how such a support divider may be positioned within a container (shown in broken lines), with five cylindrical articles C located in the five cells created by support divider 860.

Figure 30:
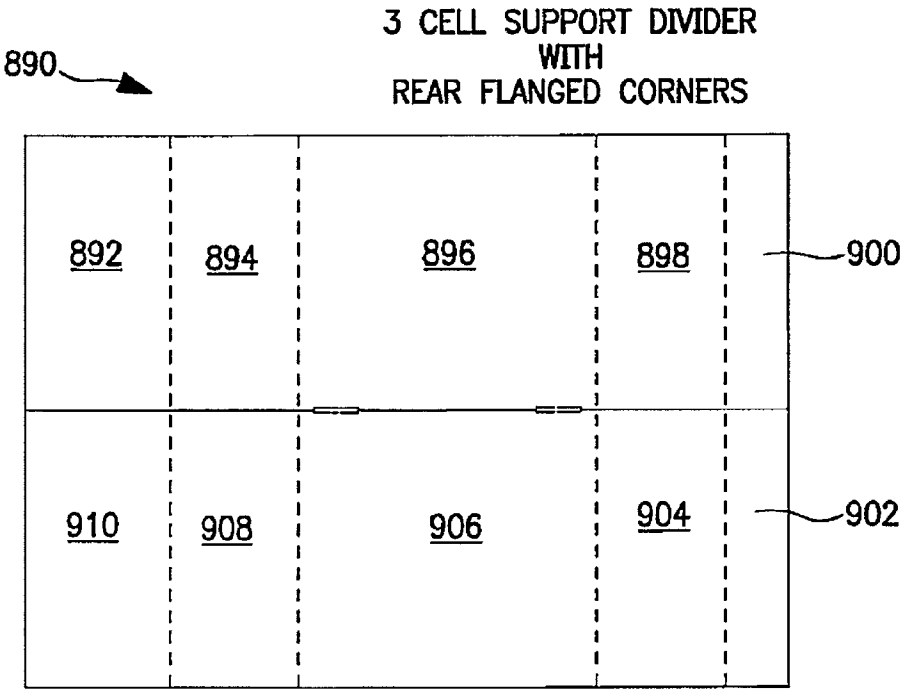
FIG. 30 is a plan view of the blank for the support divider for the outer wrap for the embodiment of FIG. 31.
Figure 29:
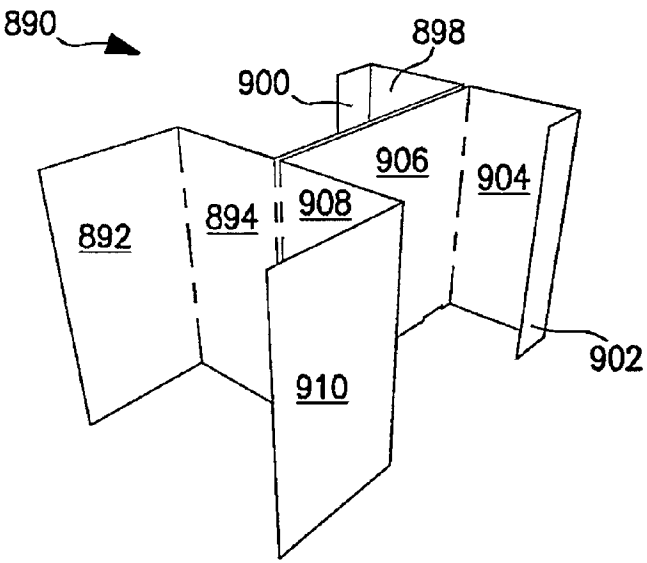
FIG. 29 is a perspective view of an erected support divider for a convertible shipping container according to another alternative embodiment.

FIGS. 29-30 illustrate an asymmetrical 3-cell support divider with rear flanged corners. Divider 890 is formed by panels 892, 894, 896, 898, 900, 902, 904, 906, 908,910. No positioning tabs are provided in the embodiment illustrated, although such tabs could be provided if necessary or desired, in accordance with the requirements of a particular application.

Figure 32:
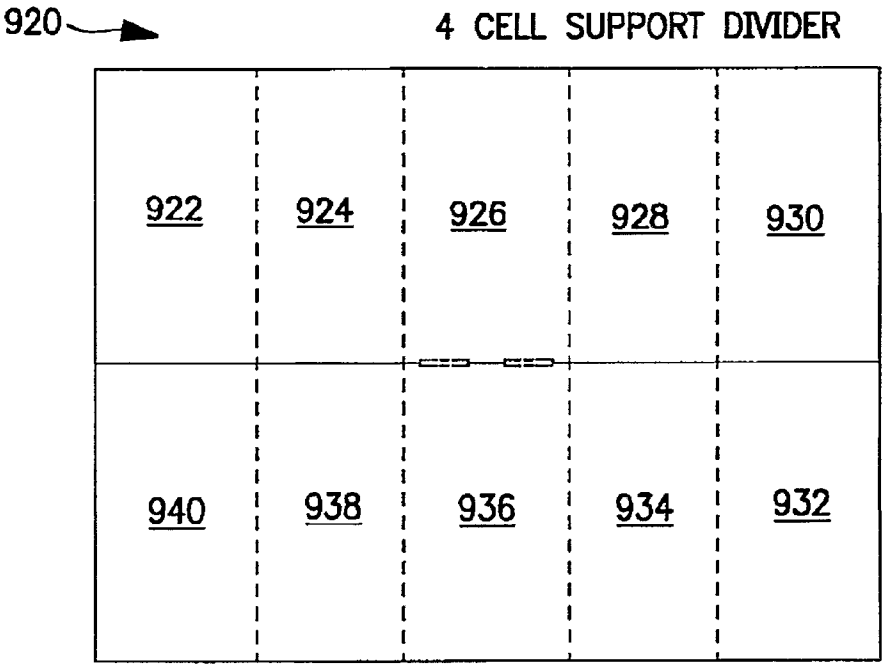
FIG. 32 is a plan view of the support divider for the outer wrap for the embodiment of FIG. 31.
Figure 31:
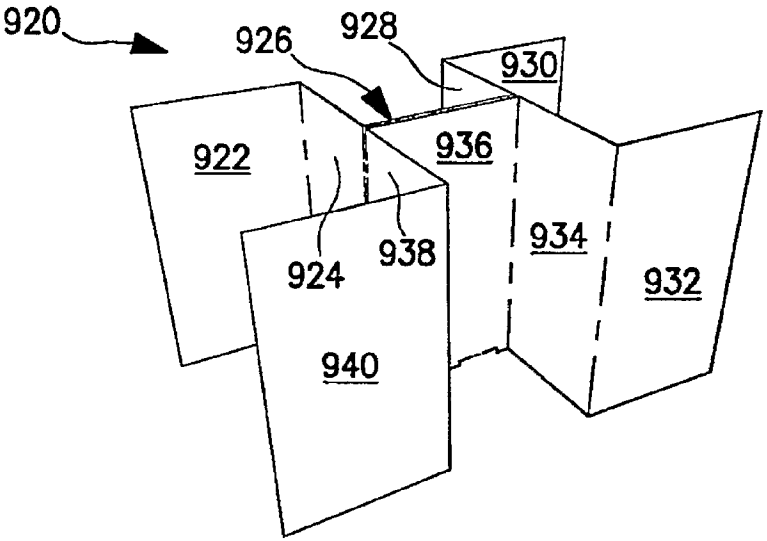
FIG. 31 is a perspective view of an erected support divider for a convertible shipping container according to another alternative embodiment.

FIGS. 31-32 illustrate a linked "C" 4-cell support divider, having a modified H-beam shape. Divider 920 is formed by panels 922, 924, 926, 928, 930, 932, 934, 936, 938, 940. No positioning tabs are provided in the embodiment illustrated, although such tabs could be provided if necessary or desired, in accordance with the requirements of a particular application.

Figure 34:
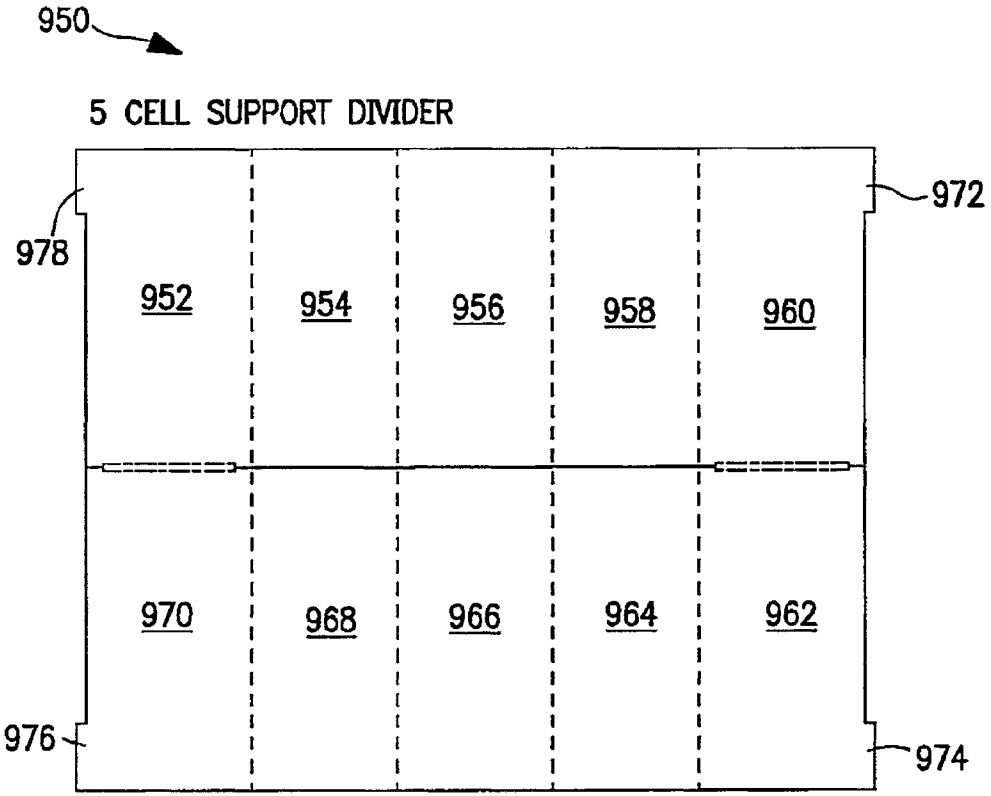
FIG. 34 is a plan view of the blank for the support divider for the outer wrap for the embodiment of FIG. 33.
Figure 33:
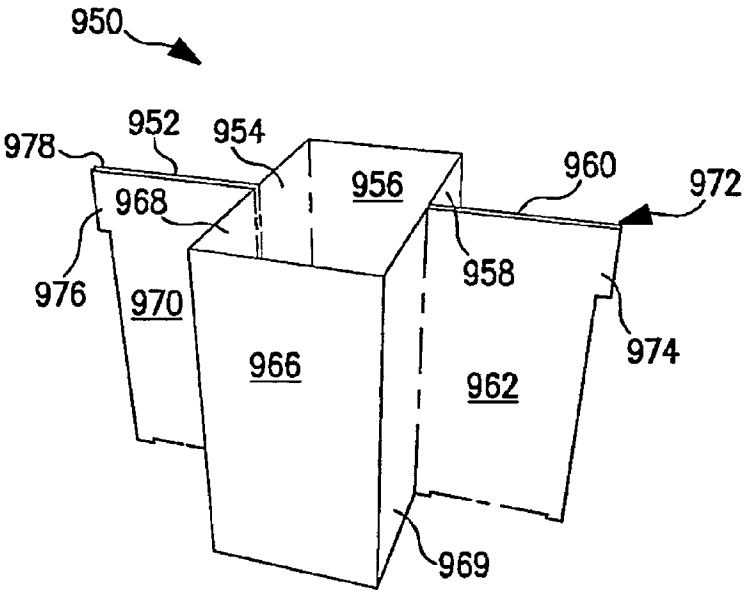
FIG. 33 is a perspective view of an erected support divider for a convertible shipping container according to another alternative embodiment.
Figure 35:
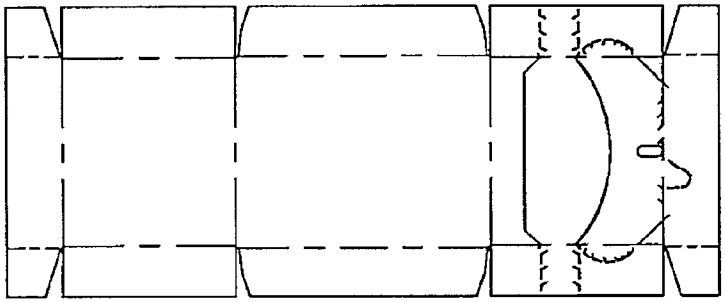
FIG. 35 is a plan view of a blank for a container having side and bottom flaps of reduced dimensions.
Figure 36:
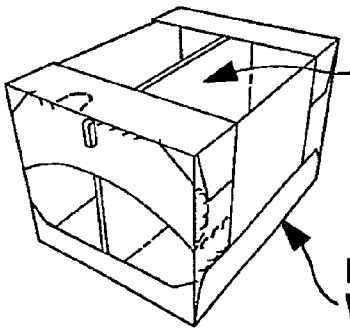
FIG. 36 is a perspective view of the container erected from the blank of FIG. 35.
Figure 39:
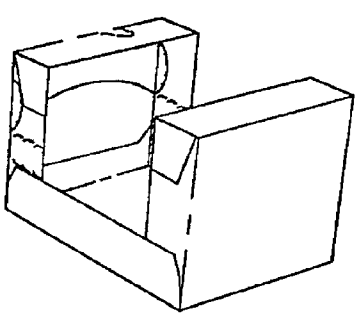
FIG. 39 is a rear perspective view of the container erected from the blank of FIG. 35.
Figure 38:
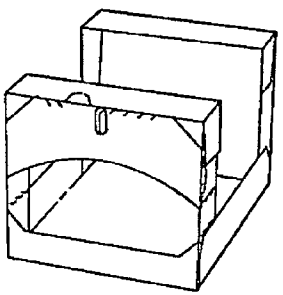
FIG. 38 is a front perspective view of the container erected from the blank of FIG. 35.
Figure 37:
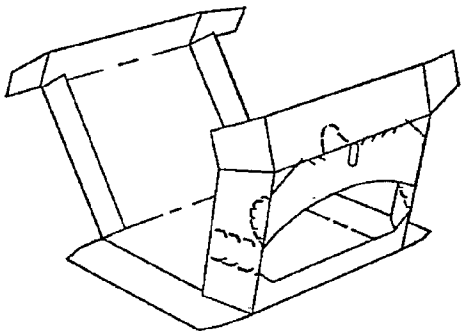
FIG. 37 is a perspective view of the container from the blank of FIG. 35, in the process of being raised.

FIGS. 33-34 illustrate a 5-cell support divider, having a modified H-beam shape. Divider 950 is formed by panels 952, 954, 956, 958, 960, 962, 964, 966, 968, 970. Positioning tabs 972, 974, 976 and 978 are provided in the embodiment illustrated, configured to be received in suitably positioned slots, typically in the front and rear walls of the container. Divider 950 forms four cells at the corners, and the rectangular enclosed columnar region forms a double cell without a further internal divider.

FIGS. 35-39 illustrate a blank and various stages of a container in which the side and bottom flaps are reduced in width for board economy, but in which the dispensing and display characteristics of the previously disclosed embodiments are still applicable.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A shipping container convertible to a display container, comprising:

an outer wrap including a bottom wall;

a front wall connected to a front edge of the bottom wall;

a rear wall connected to a rear edge of the bottom wall;

a first top panel connected to a top edge of the front wall and extending rearwardly therefrom;

a second top panel connected to a top edge of the rear wall and extending forwardly therefrom;

first and second front side panels connected to respective side edges of the front wall and extending rearwardly therefrom;

first and second rear side panels connected to respective side edges of the rear wall and extending forwardly therefrom;

first and second bottom side flaps connected to side edges of the bottom wall and extending upwardly therefrom, the first and second bottom side flaps overlapping lower portions of the first and second front and rear side panels;

first and second front top flaps connected to side edges of the first top panel, and extending downwardly therefrom;

first and second rear top flaps connected to side edges of the second top panel, and extending downwardly therefrom;

an opening disposed in at least one of the front wall and the rear wall, extending from one side edge to an opposite side edge of the at least one of the front wall and the rear wall, dividing the at least one of the front wall and the rear wall into a lower face panel having an upper free edge and an upper face panel having a lower free edge; and at least one of the front wall, rear wall, first and second top panels, first and second front side panels, and first and second rear side panels including regions of weakness, wherein the regions of weakness comprise:

a first perforation, extending from the lower free edge of the upper face panel toward a top edge of the upper face panel, adjacent one side edge thereof;

a second perforation, extending from the lower free edge of the upper face panel toward the top edge of the upper face panel, adjacent an opposite side edge thereof; and a third perforation, extending along the top edge of the upper face panel, the first, second and third perforations enabling the facilitated removal of the upper face panel from remaining portions of the shipping container, wherein the regions of weakness facilitate removal of portions of at least one of the front wall, rear wall, first and second top panels, first and second front side panels, and first and second rear side panels for facilitated access to an interior region of the shipping container.

2. The shipping container convertible to a display container, according to claim 1, further comprising:

an internal support structure including at least one internal wall member extending vertically between the bottom wall and at least one of the first and second top panels.

3. The shipping container according to claim 2, wherein the internal support structure has an E-shaped top plan configuration.

4. The shipping container according to claim 2, wherein the internal support structure is in the form of a symmetric H-shaped divider.

5. The shipping container according to claim 2, wherein the internal support structure is in the form of an asymmetrical H-shaped divider.

6. The shipping container according to claim 2, wherein the internal support structure is in the form of a five-cell divider, having an internal diamond-shaped column.

7. The shipping container according to claim 2, wherein the internal support structure is in the form of a linked "C" four cell support divider.

8. The shipping container according to claim 2, wherein the internal support structure is in the form of a five cell divider having an internal rectangular columnar support.

9. The shipping container according to claim 2, wherein the internal support structure is in the form of an asymmetrical three cell divider.

10. The shipping container according to claim 2, wherein the internal support structure is in the form of single cell "U" shaped support divider.

11. The shipping container according to claim 1, wherein the first and second front top flaps are affixed to the first and second front side panels, respectively, and wherein the regions of weakness further comprise:

first and second pairs of lines of perforations, disposed in the first and second front side panels, respectively, defining first and second zipper pull tabs, respectively, whereupon removal of the first and second zipper pull tabs, the upper face panel, the first top panel, first and second front top flaps and upper portions of the first and second front side panels are removable as a unit, to provide front and top access to remaining portions of the shipping container.

12. The shipping container according to claim 11, wherein the first and second rear top flaps are affixed to the first and second rear side panels, respectively, and wherein the regions of weakness further comprise:

first and second pairs of lines of perforations, disposed in the first and second rear side panels, respectively, and extending into and meeting in the rear wall panel, defining at least a third zipper pull tab, respectively, whereupon removal of the first, second, and at least third zipper pull tabs, the upper face panel, the first top panel, first and second front top flaps, upper portions of the first and second front side panels, the second top panel, first and second rear top flaps, upper portions of the first and second rear side panels, and an upper portion of the rear wall are removable as a unit, to provide front, top and rear access to remaining portions of the shipping container.

13. The shipping container according to claim 12, wherein the internal support structure is affixed only to at least one of the top wall, the upper face panel, an upper portion of the first front side panel, an upper portion of the second front side panel, an upper portion of the first rear side panel, an upper portion of the second rear side panel, and an upper portion of the rear wall, whereupon removal of the first, second and at least third zipper pull tabs, the internal support structure is removable with the upper face panel, the first top panel, first and second front top flaps, upper portions of the first and second front side panels, the second top panel, first and second rear top flaps, upper portions of the first and second rear side panels, and an upper portion of the rear wall, as a unit, leaving an open-topped tray as a remaining structure.

14. The shipping container according to claim 11, wherein the first and second rear top flaps are affixed to the first and second rear side panels, respectively, and wherein the regions of weakness further comprise:

a tear tape, disposed in the first and second rear side panels, and extending across the rear wall panel, whereupon removal of the first and second zipper pull tabs and the tear tape, the upper face panel, the first top panel, first and second front top flaps, upper portions of the first and second front side panels, the second top panel, first and second rear top flaps, upper portions of the first and second rear side panels, and an upper portion of the rear wall are removable as a unit, to provide front, top and rear access to remaining portions of the shipping container.

15. The shipping container according to claim 14, wherein the internal support structure is affixed only to at least one of the top wall, the upper face panel, an upper portion of the first front side panel, an upper portion of the second front side panel, an upper portion of the first rear side panel, an upper portion of the second rear side panel, and an upper portion of the rear wall, whereupon removal of the first and second zipper pull tabs and the tear tape, the internal support structure is removable with the upper face panel, the first top panel, first and second front top flaps, upper portions of the first and second front side panels, the second top panel, first and second rear top flaps, upper portions of the first and second rear side panels, and an upper portion of the rear wall, as a unit, leaving an open-topped tray as a remaining structure.

16. The shipping container according to claim 2, wherein the at least one internal wall member extending vertically between the bottom wall and at least one of the first and second top panels, includes at least one outwardly projecting tab, and wherein at least one of the first top panel, the second top panel, the front wall and the rear wall includes a notch operably configured for insertably receiving the at least one outwardly projecting tab.

17. The shipping container according to claim 2, wherein the internal support structure is fabricated from a blank separate and apart from the outer wrap.

18. A shipping container convertible to a display container, comprising a first blank having:

a rectangular bottom wall;

a front wall emanating from a front edge of the bottom wall;

a rear wall emanating from an opposite rear edge of the bottom wall;

a first top panel emanating from an edge of the front wall opposite the front edge of the bottom wall;

a second top panel emanating from an edge of the rear wall opposite the front edge of the bottom wall;

first and second front side panels emanating from respective first and second side edges of the front wall;

first and second rear side panels emanating from respective first and second side edges of the rear wall;

first and second bottom side flaps emanating from first and second side edges of the bottom wall, the first and second side edges extending substantially perpendicular to the front and rear edges of the bottom wall;

first and second front top flaps emanating from first and second side edges of the first top panel;

first and second rear top flaps emanating from first and second side edges of the second top panel;

an opening disposed in at least one of the front wall and the rear wall, extending from one side edge to an opposite side edge of the at least one of the front wall and the rear wall, dividing the at least one of the front wall and the rear wall into a lower face panel having an upper free edge and an upper face panel having a lower free edge;

at least one of the front wall, rear wall, first and second top panels, first and second front side panels, and first and second rear side panels including regions of weakness, wherein the regions of weakness comprise:

a first perforation, extending from the lower free edge of the upper face panel toward a top edge of the upper face panel, adjacent one side edge thereof;

a second perforation, extending from the lower free edge of the upper face panel toward the top edge of the upper face panel, adjacent an opposite side edge thereof; and a third perforation, extending along the top edge of the upper face panel, the first, second and third perforations enabling the facilitated removal of the upper face panel from remaining portions of the shipping container, wherein the regions of weakness facilitate removal of portions of at least one of the front wall, rear wall, first and second top panels, first and second front side panels, and first and second rear side panels for facilitated access to an interior region of the shipping container.

19. The shipping container according to claim 18, further comprising an internal support structure formed from a blank including first and second center panels, foldably connected along adjacent respective top edges thereof;

first and second back panels, foldably connected along first and second collinear fold lines to respective first and second rear edges of the first and second center panels; and first and second side panels, foldably connected along third and fourth collinear fold lines to respective first and second outer edges of the first and second back panels, opposite the first and second collinear fold lines, respectively.

20. The shipping container according to claim 18, wherein the regions of weakness further comprise:

first and second pairs of lines of perforations, disposed in the first and second front side panels, respectively, defining first and second zipper pull tabs, respectively.

21. The shipping container according to claim 18, wherein the regions of weakness further comprise:

first and second pairs of lines of perforations, disposed in the first and second rear side panels, respectively, and extending into and meeting in the rear wall panel, defining at least a third zipper pull tab.

22. The shipping container according to claim 18, wherein the regions of weakness further comprise:

a tear tape, disposed in the first and second rear side panels, and extending across the rear wall panel.

23. A shipping container convertible to a display container, comprising:

an outer wrap including a bottom wall;

a front wall connected to a front edge of the bottom wall;

a rear wall connected to a rear edge of the bottom wall;

a first top panel connected to a top edge of the front wall and extending rearwardly therefrom;

a second top panel connected to a top edge of the rear wall and extending forwardly therefrom;

first and second front side panels connected to respective side edges of the front wall and extending rearwardly therefrom;

first and second rear side panels connected to respective side edges of the rear wall and extending forwardly therefrom;

first and second bottom side flaps connected to side edges of the bottom wall and extending upwardly therefrom, the first and second bottom side flaps overlapping lower portions of the first and second front and rear side panels;

first and second front top flaps connected to side edges of the first top panel, and extending downwardly therefrom, wherein the first and second front top flaps are affixed to the first and second front side panels, respectively;

first and second rear top flaps connected to side edges of the second top panel, and extending downwardly therefrom;

an opening disposed in at least one of the front wall and the rear wall, extending from one side edge to an opposite side edge of the at least one of the front wall and the rear wall, dividing the at least one of the front wall and the rear wall into a lower face panel having an upper free edge and an upper face panel having a lower free edge; and at least one of the front wall, rear wall, first and second top panels, first and second front side panels, and first and second rear side panels including regions of weakness, wherein the regions of weakness comprise:

first and second pairs of lines of perforations, disposed in the first and second front side panels, respectively, defining first and second zipper pull tabs, respectively, whereupon removal of the first and second zipper pull tabs, the upper face panel, the top panel, first and second front top flaps and upper portions of the first and second front side panels are removable as a unit, to provide front and top access to remaining portions of the shipping container.

24. A shipping container convertible to a display container, comprising:

an outer wrap including a bottom wall;

a front wall connected to a front edge of the bottom wall;

a rear wall connected to a rear edge of the bottom wall;

a first top panel connected to a top edge of the front wall and extending rearwardly therefrom;

a second top panel connected to a top edge of the rear wall and extending forwardly therefrom;

first and second front side panels connected to respective side edges of the front wall and extending rearwardly therefrom;

first and second rear side panels connected to respective side edges of the rear wall and extending forwardly therefrom;

first and second bottom side flaps connected to side edges of the bottom wall and extending upwardly therefrom, the first and second bottom side flaps overlapping lower portions of the first and second front and rear side panels;

first and second front top flaps connected to side edges of the first top panel, and extending downwardly therefrom, wherein the first and second front top flaps are affixed to the first and second front side panels, respectively;

first and second rear top flaps connected to side edges of the second top panel, and extending downwardly therefrom; and at least one of the front wall, rear wall, first and second top panels, first and second front side panels, and first and second rear side panels including regions of weakness, wherein the regions of weakness comprise:

a first pair of lines of perforations disposed on the first front side panel, a second pair of lines of perforations disposed on the second front side panel, the first and second lines of perforations defining a first zipper pull tab and a second zipper pull tab on the respective side panels, wherein the first zipper pull tab and the second zipper pull tab are connected by a curvilinear line of weakness extending between the side edges of the front wall and along at least a portion of the top edge of the front wall, whereupon removal of the first zipper pull tab and the second zipper pull tab, an upper portion of the front wall, the first top panel, first and second front top flaps and upper portions of the first and second front side panels are removable as a unit along the curvilinear line of weakness, to provide front and top access to remaining portions of the shipping container.

25. The shipping container according to claim 24, wherein first and second rear top flaps are connected to side edges of the second top panel, and extending downwardly therefrom, wherein the first and second rear top flaps are affixed to the first and second rear side panels, respectively, and wherein the regions of weakness further comprise:

a third pair of lines of perforations disposed on the first rear side panel and at least a portion of the rear wall, a fourth pair of lines of perforations disposed on the second rear side panel and at least a portion of the rear wall, the third and fourth lines of perforations defining a first rear tear strip and a second rear tear strip respectively, wherein the first and second rear tear strips abut on the rear wall, whereupon removal of the first and second rear tear strips, an upper portion of the rear wall, the second top panel, first and second rear top flaps and upper portions of the first and second rear side panels are removable as a unit, to provide rear and top access to remaining portions of the shipping container.

26. A shipping container convertible to a display container, comprising:

an outer wrap including a bottom wall;

a front wall connected to a front edge of the bottom wall;

a rear wall connected to a rear edge of the bottom wall;

a first top panel connected to a top edge of the front wall and extending rearwardly therefrom;

a second top panel connected to a top edge of the rear wall and extending forwardly therefrom;

first and second front side panels connected to respective side edges of the front wall and extending rearwardly therefrom;

first and second rear side panels connected to respective side edges of the rear wall and extending forwardly therefrom;

first and second bottom side flaps connected to side edges of the bottom wall and extending upwardly therefrom, the first and second bottom side flaps overlapping lower portions of the first and second front and rear side panels;

first and second front top flaps connected to side edges of the first top panel, and extending downwardly therefrom, wherein the first and second front top flaps are affixed to the first and second front side panels, respectively;

first and second rear top flaps connected to side edges of the second top panel, and extending downwardly therefrom; and at least one of the front wall, rear wall, first and second top panels, first and second front side panels, and first and second rear side panels including regions of weakness, wherein the regions of weakness comprise:

a line of weakness disposed on the first front side panel, the front wall and the second front side panel such that the line of weakness extends at least partially along a central portion of the top edge of the front wall, whereupon separating along the line of weakness provides front access to remaining portions of the shipping container.

27. A shipping container convertible to a display container, comprising:

an outer wrap including a bottom wall;

a front wall connected to a front edge of the bottom wall, the front wall having an area;

a rear wall connected to a rear edge of the bottom wall;

a first top panel connected to a top edge of the front wall and extending rearwardly therefrom;

a second top panel connected to a top edge of the rear wall and extending forwardly therefrom;

first and second front side panels connected to respective side edges of the front wall and extending rearwardly therefrom;

first and second rear side panels connected to respective side edges of the rear wall and extending forwardly therefrom;

first and second bottom side flaps connected to side edges of the bottom wall and extending upwardly therefrom, the first and second bottom side flaps overlapping lower portions of the first and second front and rear side panels;

first and second front top flaps connected to side edges of the first top panel, and extending downwardly therefrom;

first and second rear top flaps connected to side edges of the second top panel, and extending downwardly therefrom; and at least one of the front wall, rear wall, first and second top panels, first and second front side panels, and first and second rear side panels including regions of weakness for facilitating removal of portions thereof, wherein a first region of weakness facilitates removal of a portion of the front wall creating an access opening having an area greater than one half of the area of the front wall for facilitated access to an interior region of the shipping container and wherein the perimeter of the first region of weakness includes a substantially continuous curvilinear portion extending between opposing side edges of the front wall.

28. A shipping container convertible to a display container, comprising a first blank having:

a rectangular bottom wall;

a front wall emanating from a front edge of the bottom wall;

a rear wall emanating from an opposite rear edge of the bottom wall;

a first top panel emanating from an edge of the front wall opposite the front edge of the bottom wall;

a second top panel emanating from an edge of the rear wall opposite the front edge of the bottom wall;

first and second front side panels emanating from respective first and second side edges of the front wall;

first and second rear side panels emanating from respective first and second side edges of the rear wall;

first and second bottom side flaps emanating from first and second side edges of the bottom wall, the first and second side edges extending substantially perpendicular to the front and rear edges of the bottom wall;

first and second front top flaps emanating from first and second side edges of the first top panel;

first and second rear top flaps emanating from first and second side edges of the second top panel;

an opening disposed in at least one of the front wall and the rear wall, extending from one side edge to an opposite side edge of the at least one of the front wall and the rear wall, dividing the at least one of the front wall and the rear wall into a lower face panel having an upper free edge and an upper face panel having a lower free edge; and at least one of the front wall, rear wall, first and second top panels, first and second front side panels, and first and second rear side panels including regions of weakness, wherein the regions of weakness comprise:

first and second pairs of lines of perforations, disposed in the first and second front side panels, respectively, defining first and second zipper pull tabs, respectively, whereupon removal of the first and second zipper pull tabs, the upper face panel, the first top panel, first and second front top flaps and upper portions of the first and second front side panels are removable as a unit, to provide front and top access to remaining portions of the shipping container.

29. A shipping container convertible to a display container, comprising a first blank having:

a rectangular bottom wall;

a front wall emanating from a front edge of the bottom wall;

a rear wall emanating from an opposite rear edge of the bottom wall;

a first top panel emanating from an edge of the front wall opposite the front edge of the bottom wall;

a second top panel emanating from an edge of the rear wall opposite the front edge of the bottom wall;

first and second front side panels emanating from respective first and second side edges of the front wall;

first and second rear side panels emanating from respective first and second side edges of the rear wall;

first and second bottom side flaps emanating from first and second side edges of the bottom wall, the first and second side edges extending substantially perpendicular to the front and rear edges of the bottom wall;

first and second front top flaps emanating from first and second side edges of the first top panel;

first and second rear top flaps emanating from first and second side edges of the second top panel; and at least one of the front wall, rear wall, first and second top panels, first and second front side panels, and first and second rear side panels including regions of weakness, wherein the regions of weakness comprise:

a first pair of lines of perforations disposed on the first front side panel, a second pair of lines of perforations disposed on the second front side panel, the first and second lines of perforations defining a first zipper pull tab and a second zipper pull tab on the respective side panels, wherein the first zipper pull tab and the second zipper pull tab are connected by a curvilinear line of weakness extending between the side edges of the front wall and along at least a portion of the top edge of the front wall, whereupon removal of the first zipper pull tab and the second zipper pull tab, an upper portion of the front wall, the first top panel, first and second front top flaps and upper portions of the first and second front side panels are removable as a unit along the curvilinear line of weakness, to provide front and top access to remaining portions of the shipping container.

30. The shipping container according to claim 29, wherein the regions of weakness further comprise:

a third pair of lines of perforations disposed on the first rear side panel and at least a portion of the rear wall, a fourth pair of lines of perforations disposed on the second rear side panel and at least a portion of the rear wall, the third and fourth lines of perforations defining a first rear tear strip and a second rear tear strip respectively, wherein the first and second rear tear strips abut on the rear wall, whereupon removal of the first and second rear tear strips, an upper portion of the rear wall, the second top panel, first and second rear top flaps and upper portions of the first and second rear side panels are removable as a unit, to provide rear and top access to remaining portions of the shipping container.

31. A shipping container convertible to a display container, comprising a first blank having:

a rectangular bottom wall;

a front wall emanating from a front edge of the bottom wall;

a rear wall emanating from an opposite rear edge of the bottom wall;

a first top panel emanating from an edge of the front wall opposite the front edge of the bottom wall;

a second top panel emanating from an edge of the rear wall opposite the front edge of the bottom wall;

first and second front side panels emanating from respective first and second side edges of the front wall;

first and second rear side panels emanating from respective first and second side edges of the rear wall;

first and second bottom side flaps emanating from first and second side edges of the bottom wall, the first and second side edges extending substantially perpendicular to the front and rear edges of the bottom wall;

first and second front top flaps emanating from first and second side edges of the first top panel;

first and second rear top flaps emanating from first and second side edges of the second top panel; and at least one of the front wall, rear wall, first and second top panels, first and second front side panels, and first and second rear side panels including regions of weakness, wherein the regions of weakness comprise:

a line of weakness disposed on the first front side panel, the front wall and the second front side panel such that the line of weakness extends at least partially along a central portion of the top edge of the front wall, whereupon separating along the line of weakness provides front access to remaining portions of the shipping container.

32. A shipping container convertible to a display container, comprising a first blank having:

a rectangular bottom wall;

a front wall emanating from a front edge of the bottom wall, the front wall having an area;

a rear wall emanating from an opposite rear edge of the bottom wall;

a first top panel emanating from an edge of the front wall opposite the front edge of the bottom wall;

a second top panel emanating from an edge of the rear wall opposite the front edge of the bottom wall;

first and second front side panels emanating from respective first and second side edges of the front wall;

first and second rear side panels emanating from respective first and second side edges of the rear wall;

first and second bottom side flaps emanating from first and second side edges of the bottom wall, the first and second side edges extending substantially perpendicular to the front and rear edges of the bottom wall;

first and second front top flaps emanating from first and second side edges of the first top panel;

first and second rear top flaps emanating from first and second side edges of the second top panel; and at least one of the front wall, rear wall, first and second top panels, first and second front side panels, and first and second rear side panels including regions of weakness for facilitating removal of portions thereof, wherein a first region of weakness facilitates removal of a portion of the front wall creating an access opening having an area greater than one half of the area of the front wall for facilitated access to an interior region of the shipping container and wherein the perimeter of the first region of weakness includes a substantially continuous curvilinear portion extending between opposing edges of the front wall.

* * * * *